US011208841B2

(12) United States Patent
Anderson et al.

(10) Patent No.: US 11,208,841 B2
(45) Date of Patent: Dec. 28, 2021

(54) SLATS WITH AN IMPROVED ROUTE HOLE CONFIGURATION FOR USE WITHIN A COVERING AND RELATED MANUFACTURING METHODS

(71) Applicant: Hunter Douglas Inc., Pearl River, NY (US)

(72) Inventors: Richard N. Anderson, Whitesville, KY (US); Eugene W. Thompson, Maceo, KY (US)

(73) Assignee: HUNTER DOUGLAS INC., Pearl River, NY (US)

( * ) Notice: Subject to any disclaimer, the term of this patent is extended or adjusted under 35 U.S.C. 154(b) by 383 days.

(21) Appl. No.: 16/032,788

(22) Filed: Jul. 11, 2018

(65) Prior Publication Data

US 2019/0017317 A1 Jan. 17, 2019

Related U.S. Application Data

(60) Provisional application No. 62/532,440, filed on Jul. 14, 2017.

(51) Int. Cl.

| | |
|---|---|
| ***E06B 9/327*** | (2006.01) |
| ***E06B 9/303*** | (2006.01) |
| ***E06B 9/326*** | (2006.01) |
| ***E06B 9/266*** | (2006.01) |
| ***E06B 9/386*** | (2006.01) |

(52) U.S. Cl.

CPC ..... *E06B 9/327* (2013.01); *E06B 9/266* (2013.01); *E06B 9/303* (2013.01); *E06B 9/326* (2013.01); *E06B 9/386* (2013.01)

(58) Field of Classification Search

CPC ..... E06B 9/327; E06B 9/266; E06B 9/303; E06B 9/386; E06B 9/30; E06B 9/38; E06B 9/384; E06B 9/326

See application file for complete search history.

(56) References Cited

U.S. PATENT DOCUMENTS

| | | | | |
|---|---|---|---|---|
| 2,608,249 A | | 8/1952 | Sealy | |
| 4,088,171 A | * | 5/1978 | Schluep | E06B 9/307 160/170 |
| 5,176,193 A | | 1/1993 | Yannazzone | |
| 5,196,193 A | * | 3/1993 | Carroll | C07K 16/02 424/172.1 |

(Continued)

FOREIGN PATENT DOCUMENTS

| | | |
|---|---|---|
| EP | 0954672 B1 | 5/2003 |
| JP | 1545452 S | 3/2016 |

(Continued)

*Primary Examiner* — Daniel P Cahn
*Assistant Examiner* — Matthew R. Shepherd
(74) *Attorney, Agent, or Firm* — Dority & Manning, P.A.

(57) ABSTRACT

In one aspect, a slat configured for use with a covering for an architectural structure includes a route slot defined at least partially by a route wall that is recessed relative to one or more outer faces of the slat. Additionally, the recessed route wall further defines a through-hole for passing a cord through the route slot between the opposed outer faces of the slat. By configuring the disclosed route slot in this manner, the dimensions of the through-hole can be significantly reduced while still allowing full tilting of the slat to the closed position, thereby increasing light control and privacy for the associated covering.

17 Claims, 17 Drawing Sheets

(56) References Cited

U.S. PATENT DOCUMENTS

| | | | | |
|---|---|---|---|---|
| 5,375,642 | A * | 12/1994 | Gaber | E06B 9/302 160/168.1 R |
| D413,475 | S | 9/1999 | Swapp | |
| 6,003,218 | A | 12/1999 | Schumann et al. | |
| 6,029,553 | A | 2/2000 | Berntsson et al. | |
| 6,131,640 | A | 10/2000 | Judkins | |
| 6,263,944 | B1 | 7/2001 | Judkins | |
| 6,443,042 | B1 | 9/2002 | Caputo et al. | |
| 6,557,615 | B2 * | 5/2003 | Smith | E06B 9/303 160/176.1 R |
| 6,560,849 | B1 | 5/2003 | Modra | |
| 6,817,400 | B2 | 11/2004 | Corey et al. | |
| 7,028,737 | B2 | 4/2006 | Hsu | |
| D698,583 | S | 2/2014 | Lin | |
| D699,050 | S | 2/2014 | Lin | |
| 2006/0278350 | A1 | 12/2006 | Zamarripa | |
| 2007/0095485 | A1 | 5/2007 | Bodner | |
| 2008/0295978 | A1 | 12/2008 | Keasberry | |
| 2009/0183843 | A1 * | 7/2009 | Chou | E06B 9/384 160/218 |
| 2014/0193600 | A1 | 7/2014 | Barudin | |
| 2016/0312529 | A1 * | 10/2016 | Fonville | E06B 9/307 |

FOREIGN PATENT DOCUMENTS

| | | | |
|---|---|---|---|
| JP | 1567054 | S | 1/2017 |
| WO | WO2004/053279 | | 6/2004 |

* cited by examiner

SLATS WITH AN IMPROVED ROUTE HOLE CONFIGURATION FOR USE WITHIN A COVERING AND RELATED MANUFACTURING METHODS

CROSS-REFERENCE TO RELATED APPLICATIONS

This application is based upon and claims the right of priority to U.S. Provisional Patent Application No. 62/532,440, filed Jul. 14, 2017, the disclosure of which is hereby incorporated by reference herein in its entirety for all purposes.

FIELD

The present subject matter relates generally to slats configured for use with coverings for architectural structures and, more particularly, to slats having an improved route hole configuration that provides enhanced light blocking capabilities and increased privacy for an associated covering as compared to slats having conventional route holes. In addition, the present subject matter is also directed to related manufacturing methods for forming an improved route slot within a slat as well as coverings made with slats having improved route slots.

BACKGROUND

Coverings, such as horizontal/Venetian blinds and other similar blinds, typically include a headrail, a bottom rail, and a plurality of horizontally oriented slats configured to be supported between the headrail and the bottom rail via two or more sets of cord ladders. Additionally, one or more lift cords typically extend between the headrail and the bottom rail for adjusting the position of the bottom rail relative to the headrail, with each lift cord typically passing through a set of aligned route holes defined in the slats. As is generally understood, conventional route holes correspond to elongated through-hole having a substantially rectangular shape with generally rounded-offends.

Unfortunately, given their shape and typical dimensions, conventional route holes generally allow for a significant amount of light to pass through a blind when the slats have been tilted to their fully closed position. As such, the light-blocking functionality of the blind may be hindered. Additionally, the light gaps defined between the lift cord and the outer perimeter of conventional route holes often allow for a view through the blind when the blind is closed, thereby creating privacy concerns for homeowners with such blinds.

Moreover, to meet consumer demands related to the amount of privacy and light control provided by a Venetian blind when in the closed position, it is desirable for the slats to be capable of being tilted as close as possible to a vertical orientation. In this regard, both the diameter of the lift cord and the thickness of the slat impact the required dimensions of conventional route holes to accommodate the desired tilt angle. Specifically, the greater the thickness of the slat and/or the greater the cord diameter, the longer the route hole generally must be to achieve the desired tilt angle for the slats. As a result, designers of conventional Venetian blinds must balance the desire for having sturdier, thicker slats with the reduction in privacy and light control resulting from the accompanying increase in the length of the associated route holes.

Accordingly, an improved route hole configuration for slats that addresses one or more of the issues associated with conventional route holes would be welcomed in the technology.

BRIEF SUMMARY

Aspects and advantages of the present subject matter will be set forth in part in the following description, or may be obvious from the description, or may be learned through practice of the present subject matter.

In various aspects, the present subject matter is directed to a slat configured for use with a covering for an architectural structure that includes an improved route hole configuration. Specifically, in several embodiments, the slat includes a route slot having a through-hole for passing a cord between the opposed outer faces of a slat body of the slat. Additionally, the route slot includes one or more recessed areas or recesses defined relative to the outer faces of the slat body that extend outwardly from and/or surround the through-hole to accommodate the cord at its maximum tilt angle when the slat is moved to a closed position. By configuring the disclosed route slot in this manner, the dimensions of the through-hole can be significantly reduced as compared to conventional route or through holes that allow for the same maximum tilt angle for the slat, thereby increasing light control and privacy for the associated covering.

Additionally, in various aspects, the present subject matter is also directed to a covering for an architectural structure that incorporates slats having an improved route hole configuration. For example, in one embodiment, the covering includes a headrail, a bottom rail, and a plurality of slats supported between the headrail and bottom rail. In such an embodiment, each slat may include one or more route slots configured in accordance with the disclosure provided herein.

These and other features, aspects, and advantages of the present subject matter will become better understood with reference to the following Detailed Description and appended claims. The accompanying drawings, which are incorporated in and constitute a part of this specification, illustrate embodiments of the present subject matter and, together with the description, serve to explain the principles of the present subject matter.

This Brief Description is provided to introduce a selection of concepts in a simplified form that are further described below in the Detailed Description. This Brief Description is not intended to identify key features or essential features of the claimed subject matter, nor is it intended as an aid in determining the scope of the claimed subject matter.

BRIEF DESCRIPTION OF THE DRAWINGS

A full and enabling disclosure of the present subject matter, including the best mode thereof, directed to one of ordinary skill in the art, is set forth in the specification, which makes reference to the appended figures, in which.

DETAILED DESCRIPTION

Figure 1:
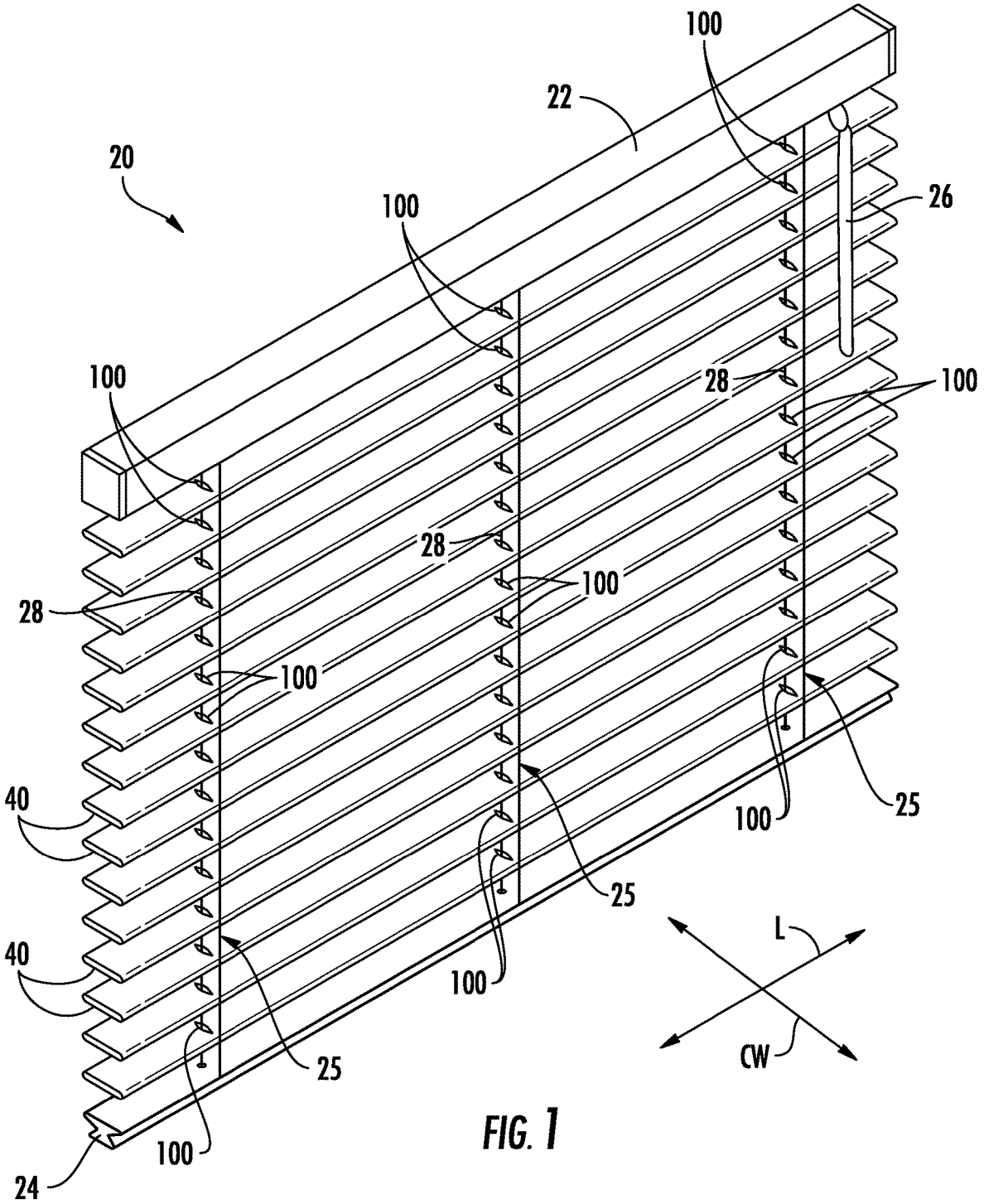
FIG. 1 illustrates a perspective view of one embodiment of a covering for an architectural structure in accordance with aspects of the present subject matter, particularly illustrating the covering including a plurality of slats tilted to an open position.

In general, the present subject matter is directed to a slat configured for use with a covering for an architectural feature or structure (referred to herein simply as an architectural "structure" for the sake of convenience and without intent to limit). Specifically, in several embodiments, a route slot is defined in the slat that includes a through-hole through which an associated cord of the covering (e.g. a lift cord) passes. As will be described below, given the configuration of the disclosed route slot, the dimensions of the through-hole may be significantly reduced as compared to conventional route or through holes without negatively impacting the maximum tilt angle for the slat. For instance, in one embodiment, in addition to the through-hole, the route slot may also include one or more recessed areas or recesses defined relative to outer faces of the slat that extend outwardly from and/or surround the through-hole to accommodate the cord at its maximum tilt angle. As such, by installing slats having the disclosed route slots formed therein within a covering, the slats may provide increased light control and improved privacy for the covering when the slats are tilted to their closed position.

In one embodiment, each slat includes a slat body defining first and second faces along opposed sides of the slat body. Each face of the slat body extends in a longitudinal direction of the slat between a first lateral end and a second lateral end of the slat body and in a crosswise direction of the slat between a first edge and a second edge of the slat body. In addition, the slat body extends in a thickness direction of the slat between the opposed sides of the slat body such that the slat body defines a thickness directly between its first and second faces.

Additionally, in one embodiment, the route slot is defined by a recessed route wall positioned relative to each of the first and second faces of the slat body such that the route slot is defined between the first and second faces of the slat body and extends through the slat body to accommodate passage of a cord of a covering therethrough. For example, in one embodiment, the route wall extends radially from an outer end defining an outer perimeter of the route slot to an opposed inner end, with the inner end being recessed relative to the outer faces of the slat body. In such an embodiment, the through-hole of the route slot is defined by the inner, recessed end of the route wall to provide an opening to allow the cord of the associated covering to pass through the slat body. For example, in one embodiment, the inner end of the route wall may be recessed relative to the outer faces of the slat body such that the through-hole is defined at the actual or apparent center of the thickness of the slat. Moreover, in one embodiment, outer surfaces of the portions of the recessed route wall extending radially outwardly from the through-hole may at least partially define recessed areas or recesses of the route slot that at least partially surround the through-hole. In such an embodiment, when the slat is tilted to its closed position, the cord may extend through at least a portion of the recesses defined between the outer surfaces of the recessed route wall and the outer faces of the slat body to allow the route slot to accommodate the cord with the slat body orientated at its maximum tilt angle.

By configuring the disclosed route slot as described above, the required dimensions of the through-hole may be controlled primarily by the diameter of the cord passing therethrough (as opposed to both the cord diameter and the thickness of the slat). Specifically, in one embodiment, the dimension of the through-hole in the longitudinal direction of the slat need only be large enough to accommodate the diameter of the cord while the dimension of the through-hole in the crosswise direction of the slat need only be large enough to allow the lift cord to extend through the through-hole at the desired maximum tilt angle for the slat. In such an embodiment, the cross-wise dimension of the through-hole may be minimized, at least in part, due to the remainder of the route slot (e.g., the recessed portions of the route slot defined by the portions of the recessed route wall extending radially outwardly from the through-hole) being configured to accommodate portions of the cord as it extends through the route slot (as opposed to the cord being accommodated solely by a through-hole for conventional designs). For example, as will be described below, the remainder of the route slot may be shaped or sized to provide the necessary cord clearance for achieving the desired maximum tilt angle. Thus, as compared to conventional route holes that require significantly elongated through-holes to allow the same or a similar maximum tilt angle to be achieved, the through-hole dimensions can be significantly decreased in a manner that reduces both the amount of light transmitted through the route slot and the ability to "see-through" the slats (i.e., privacy).

In one embodiment, the recessed route wall defining the disclosed route slot is formed by a portion of the slat body of the associated slat. For instance, the route wall may correspond to an integral portion of the slat body extending radially within the route slot between the opposed outer faces of the slat body. Alternatively, the route wall may be defined by a separate component of the slat. For example, in one embodiment, the route wall is defined by a separate insert configured to be installed relative to the slat body (e.g., within an insert opening defined through the slat body).

Additionally, in one embodiment, the route wall extends radially inwardly relative to the outer perimeter of the route slot between the opposed outer faces of the slat body such that the route wall at least partially divides the route slot into separate slot portions or recesses connected to each other via the through-hole of the route slot. For example, in one embodiment, the route slot may include a first slot portion or recess extending in the thickness direction of the slat between the first face of the slat body and the through-hole, and a second slot portion or recess extending in the thickness direction of the slat between the second face of the slat body and the through-hole. In such an embodiment, the route wall may extend radially between the first and second recesses such that the first recess is spaced apart from the second recess in the thickness direction of the slat between the radially inner and outer ends of the route wall.

Moreover, in one embodiment, the route wall defines a tapered profile that tapers down and into the through-hole of the route slot. Specifically, in one example, the route wall defines a tapered profile between the first and second recesses of the route slot such that a depth of each recess into the slat increases as the thickness of the route wall decreases as the wall extends radially inwardly in the direction of the through-hole. For example, the route wall may include sloped outer surfaces extending inwardly between the outer faces of the slat body and the through-hole such that the route wall tapers down from the outer faces of the slat body to the perimeter of the through-hole. In such an embodiment, a taper angle of the sloped outer surfaces may be greater than or equal to the desired maximum tilt angle for the slat to ensure that the route slot provides sufficient cord clearance for achieving such tilt angle.

Further, in one embodiment, a slat configured for use with a covering for an architectural structure includes a slat body having opposed first and second faces extending in a longitudinal direction between first and second lateral ends of the slat body and in a crosswise direction between first and second edges of the slat body. The first and second faces are spaced apart from each other in a thickness direction of the slat body. Additionally, in one embodiment, the slat includes a route wall at least partially recessed relative to at least one of the first face or the second face in the thickness direction of the slat body such that the route wall defines a route slot including at least one recess formed along the first face and/or the second face of the slat body. Moreover, in one embodiment, the route slot further includes a through-hole defined by the route wall that extends between the first and second faces of the slat body for passing a cord through the slat body. In such an embodiment, the recess of the route slot is enlarged relative to the through-hole of the route slot in at least one direction of the slat body such that the recess at least partially surrounds the through-hole.

By configuring the route wall to define a route slot including a recess that surrounds or is otherwise enlarged relative to the associated through-hole of the route slot, the recess can be configured to accommodate portions of the cord passing through the route slot when the slat is tilted, thereby allowing for the relative dimension(s) of the through-hole to be reduced without negatively impacting the maximum tilt angle for the slat. For example, in one embodiment, a portion of the recess extending outwardly from the perimeter of the through-hole (e.g., in a direction parallel to the central slat plane of the slat) may be configured to define a recessed cord path along the outer face of the slat body for receiving a portion of the cord when the slat is tilted to its maximum tilt angle. In such an embodiment, the recessed cord path defined by the enlarged recess facilitates tilting of the slat to the maximum tilt angle so that the corresponding dimension(s) of the through-hole can be reduced.

In one embodiment, the recess extends to an outer perimeter of the route slot and an inner end of the recessed route wall defines a through-hole perimeter of the through-hole. In such an embodiment, the recess may be enlarged relative to the through-hole such that a dimension of the outer perimeter of the route slot in at least one of the longitudinal direction or the cross-wise direction of the slat body is greater than a corresponding dimension of the perimeter of the through-hole in the at least one the longitudinal direction or the crosswise direction. For example, in one embodiment, the recess defines a slot length in the crosswise direction of the slat body that is greater than a corresponding through-hole length of the through-hole defined in the crosswise direction of the slat body. In such an embodiment, the portion(s) of the recess that is enlarged relative to the through-hole in the crosswise direction of the slat body may define a recessed cord path for receiving a corresponding portion of the cord when the slat is tilted.

As indicated above, in several embodiments, slats having the improved route hole configuration may be incorporated into a covering for an architectural structure. For example, in one embodiment, the covering includes a headrail, a bottom rail spaced apart from the headrail, and a lift cord extending between the headrail and the bottom rail. In addition, the covering includes a plurality of slats supported between the headrail and the bottom rail via one or more cord ladders, with each slat including a route slot configured in accordance with one or more aspects of the present subject matter. As such, the lift cord may pass through the aligned route slots of the slats as it extends between the headrail and the bottom rail.

Moreover, the present subject matter is also directed to a method for manufacturing slats having an improved route hole configuration. For example, in one embodiment, the method includes positioning a slat body of a slat relative to a slot-forming component and moving the slot-forming component relative to the slat body to form a route slot therein. In such an embodiment, the route slot formed within the slat body is configured in accordance with description provided herein.

In one embodiment, the slot-forming component corresponds to a die assembly including an upper die and a lower die. In such an embodiment, a portion of the slat body is configured to be compressed between the upper and lower dies to form the route slot within the slat body, with the slat material compressed between the upper and lower dies forming the recessed route wall described herein. Additionally, in one embodiment, the die assembly includes a punch configured to punch-through the slat body to form the through-hole of the route slot. In such an embodiment, the punch may be movable relative to the upper and/or lower dies or may be fixed relative to the upper and/or lower dies (e.g., by forming the punch integrally with one of the dies or by rigidly coupling the punch to one of the dies). In one embodiment, when the punch is movable relative to the upper and/or lower dies, the die assembly is configured to perform a two-stage embossing punch process in which the upper and lower dies initially compress the slat body at the desired location of the route slot prior to the punch being actuated relative to the dies to punch-out the through-hole of the route slot. Moreover, in one embodiment, when the punch is fixed relative to the upper and/or lower die, the die assembly is configured to perform a single-stage embossing punch press in which the punch is used to punch-out the through-hole as the slat material is being compressed between the upper and lower dies at the desired location of the route slot.

Further, in one embodiment, the slot-forming component corresponds to one or more cutting devices (e.g., one or more saws) configured to remove material from the slat body to form the route slot. In such an embodiment, the cutting device(s) is used to make first and second cuts along the opposed outer faces of the slat to form the first and second slot portions or recesses of the route slot. For example, each cut may be used to actively form a recess on each side of the slot, with the cuts being made along opposed sides of the slat. In one embodiment, the cuts made by the cutting device(s) overlap each other such that the through-hole of the route slot is formed via the cuts made to the opposing sides of the slat. Alternatively, the cuts made by the cutting devices may be non-overlapping such that a portion of the slat body remains at the desired location of the through-hole following the cuts. In such an embodiment, a secondary operation (e.g., a secondary punch operation) may be used to remove the remaining slat material and, thus, form the through-hole.

Additionally, in one embodiment, the manufacturing method used to form the disclosed route slot may vary or be selected depending on the slat material. For instance, malleable materials, such as plastic materials, are often better suited for being compressed via a die assembly than non-malleable materials, such as wood and other rigid materials (including coating materials applied to the exterior of slats). Specifically, non-malleable materials may often crack, chip, splinter, etc. under compression, thereby leading to an undesirable appearance or finish for the formed route slot. Similarly, when using cutting device(s), materials with relatively low melting or plastic temperatures, such as plastics or other polymer materials, may tend to heat up during the cutting process and melt at the interface between the slat and the cutting device(s), thereby resulting in undesirable material accumulation along the formed route slot (e.g., often along the exit side of the cutting device(s) or requiring modifications to be made to the cutting process. Thus, in one embodiment, for a faux wood slat (e.g., a slat formed from polyvinyl chloride (PVC), polystyrene (PS), or any other suitable plastic material), it may be desirable to compress the slat material via the die assembly to form the route slot therein. Similarly, in one embodiment, for a wood slat, it may be desirable to remove material from the slat to form the route slot (e.g., using saws or other cutting devices).

Moreover, the present subject matter is also directed to a cord threading tool configured for threading a cord (e.g., a lift cord) through aligned route slots/holes of a plurality of stack slats. In one embodiment, the tool includes an arm configured to be inserted through the aligned route slots/holes and a retention structure configured to allow the cord to be coupled to the arm. Additionally, in one embodiment, the tool includes a nesting structure configured to allow a portion(s) of the cord to the nested relative to a portion(s) of the tool arm as the arm is being pulled through the aligned route slots/holes, thereby allowing the cross-sectional profile of the tool/cord assembly to be minimized or reduced. Such a reduced cross-sectional profile may, in turn, allow for the tool to be effectively and efficiently used to thread a cord through route holes/slots having through-holes with reduced dimensions, such as within the route slot disclosed herein. Moreover, the reduced cross-sectional profile may also reduce the amount of force required to pull the tool/cord assembly through the aligned route holes/slots, thereby reducing operator effort during the assembly process.

Additionally, in one embodiment, at least a portion of the retention structure of the tool may have an angled orientation to facilitate or assist the cord being received within the nesting structure of the tool. For instance, a portion of the retention structure may define an angled cord path through the arm for directing the cord towards associated cord cradles of the nesting structure defined along opposed sides of the arm.

Figure 2:
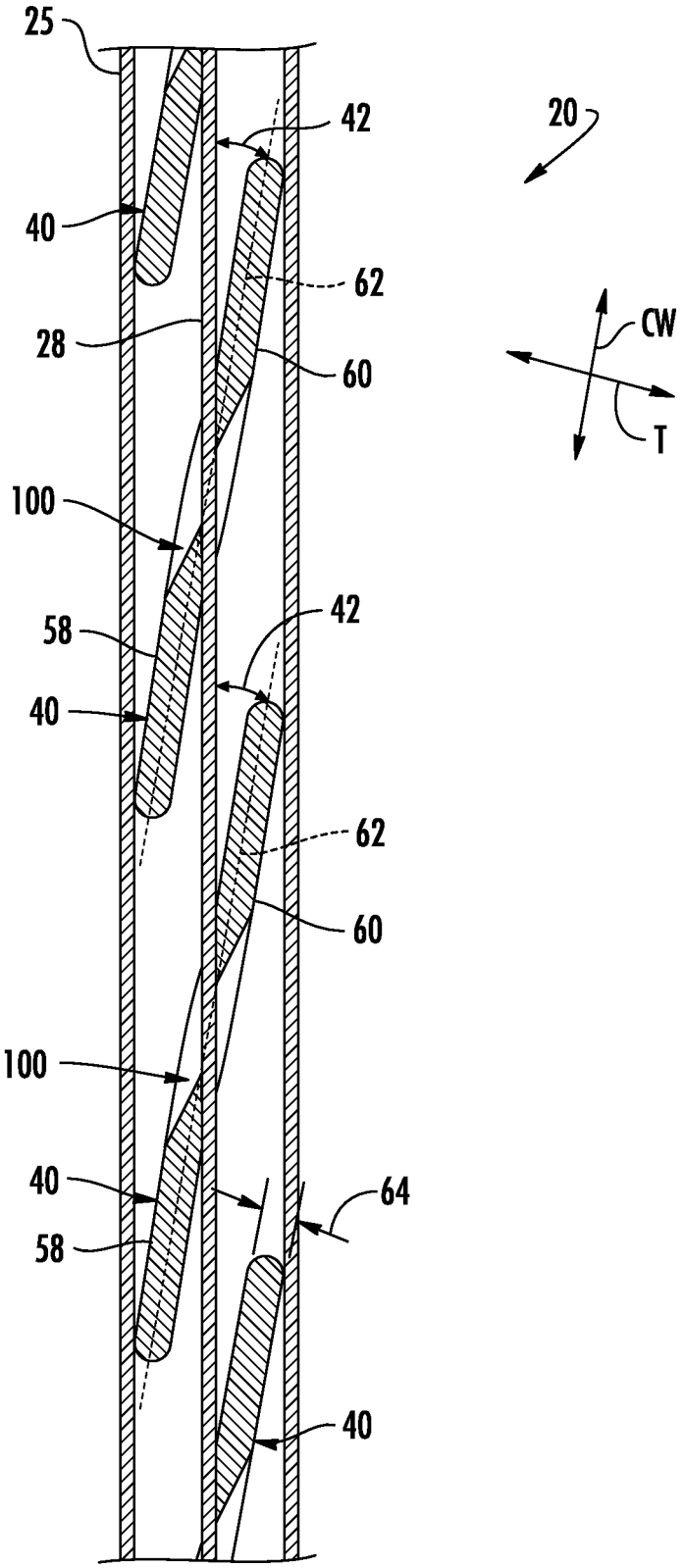
FIG. 2 illustrates a cross-sectional view of a portion of the covering shown in FIG. 1, particularly illustrating the slats tilted to a closed position at their maximum tilt angle.
Figure 3:
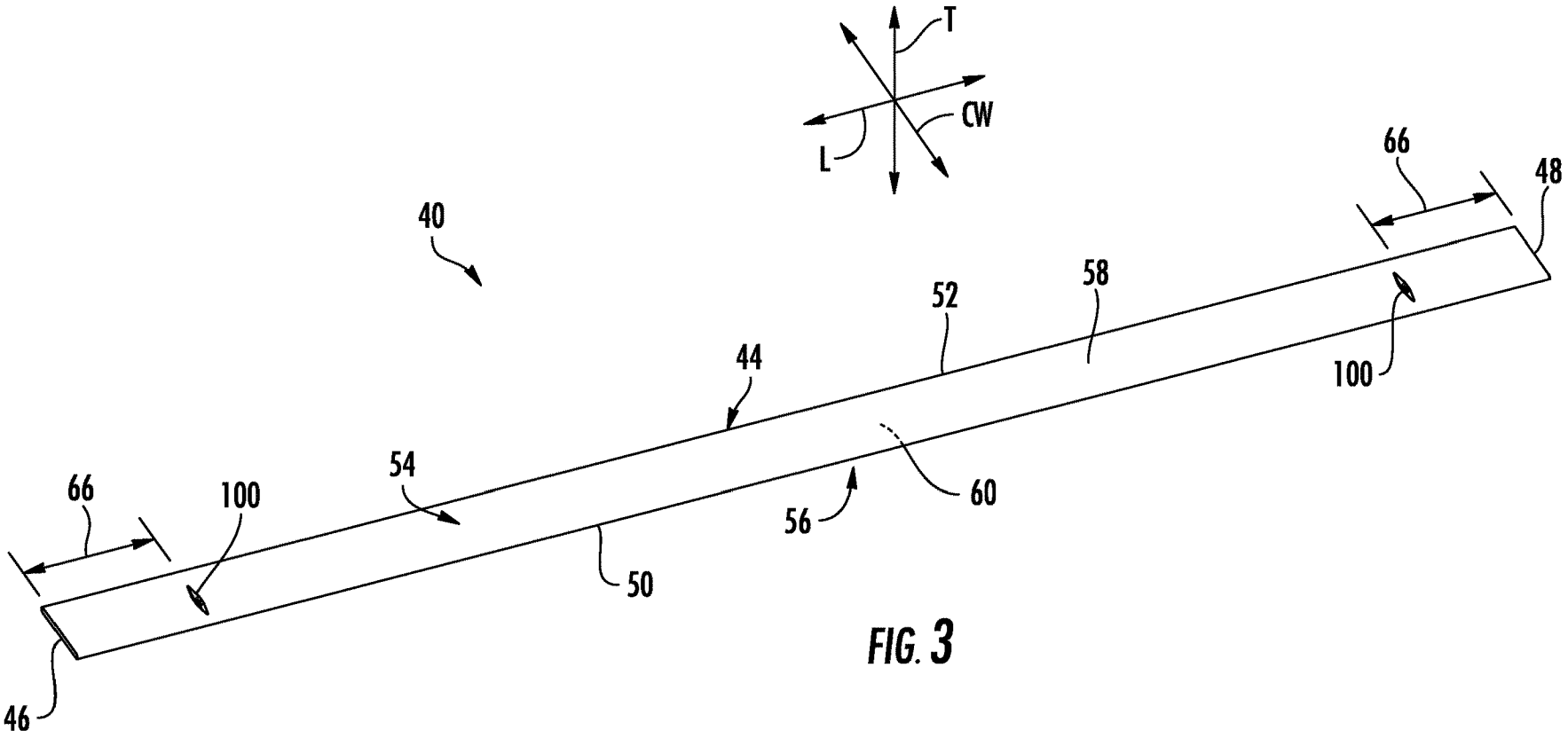
FIG. 3 illustrates a perspective view of one of the slats shown in FIGS. 1 and 2.

Referring now to FIGS. 1-3, several views of one embodiment of a covering 20 for an architectural structure (not shown) including slats 40 having an improved route hole configuration are illustrated in accordance with aspects of the present subject matter. Specifically, FIG. 1 illustrates a perspective view of the covering 20 and FIG. 2 illustrates a cross-sectional view a portion of the covering 20 when the slats 40 have been tilted to a fully closed position (i.e., to their maximum desired tilt angle 42). Additionally, FIG. 3 illustrates a perspective view of one of the slats 40 of the covering 20 shown in FIG. 1.

In general, the covering 20 may be configured to be installed relative to a window, door, or any other suitable architectural structure as may be desired. In one embodiment, the covering 20 may be configured to be mounted relative to an architectural structure to allow the covering 20 to be suspended or supported relative to the architectural structure. It should be understood that the covering 20 is not limited in its particular use as a window or door shade, and may be used in any application as a covering, partition, shade, and/or the like, relative to and/or within any type of architectural structure.

In several embodiments, the covering 20 may be configured as a Venetian-blind-type extendable/retractable covering. For example, in the embodiment shown in FIG. 1, the covering 20 includes a headrail 22, a bottom rail 24, and a plurality of horizontally disposed parallel slats 40 configured to be supported between the headrail 22 and the bottom rail 24 via one or more cord ladders 25. As is generally understood, the slats 40 may be rotatable or tiltable about their longitudinal axes by manipulating the cord ladders 25 to allow the slats 40 to be tilted between a horizontal or open position (e.g., as shown in FIG. 1) for permitting light to pass between the slats 40 and a closed position (e.g., as shown in the partial view of FIG. 2), wherein the slats 40 are substantially vertically oriented in an overlapping manner to occlude or block the passage of light through the covering 20. For example, the slats 40 may be configured to be tilted to a maximum tilt angle 42 (FIG. 2) relative to vertical when at the closed position to maximize the light blocking capabilities of the slats 40. It should be appreciated that the cord ladders 25 may be manipulated to allow for the slats 40 to be tilted between their open and closed positions using, for example, a suitable tilt wand 26 or any other suitable control device forming part of a tilt system (not shown) provided in operative association with the covering 20 (e.g., by being disposed within the headrail 22).

In the embodiment of FIG. 3, each slat 40 generally includes a slat body 44 extending in a longitudinal direction (indicated by arrow L in FIGS. 1 and 3) between a first lateral end 46 and a second lateral end 48 and in a crosswise direction (indicated by arrows CW in FIGS. 1 and 3) between a front or first slat edge 50 and a rear or second slat edge 52. In addition, the slat body 44 extends in a thickness direction (indicated by arrow T in FIGS. 2 and 3) between a first side 54 and a second side 56. As shown in FIGS. 2 and 3, the slat body 44 generally defines a first face 58 along its first side 54 that extends in the longitudinal direction L between the first and second lateral ends 46, 48 and in the crosswise direction CW between the first and second slat edges 50, 52. Similarly, the slat body 44 generally defines a second face 60 along its second side 56 that extends in the longitudinal direction L between the first and second lateral ends 46, 48 and in the crosswise direction CW between the first and second slat edges 50, 52. In one embodiment, the first and second faces 58, 60 of the slat body 44 may generally extend in the direction of a central slat plane 62 (FIG. 2) extending through the center of the slat body 44 along the longitudinal and crosswise directions L, CW of the slat 40, with the center of the slat body 44 generally being defined as the center of the body 44 in the thickness direction T of the slat 40. In one embodiment, the first and second faces 58, 60 of the slat body 44 may generally extend parallel to the central slat plane 62 along the longitudinal direction L and/or the crosswise directions CW of the slat 40. Additionally, as shown in FIG. 2, the slat 40 defines a thickness 64 in the thickness direction T between the first second faces 58, 60 of the slat body 44.

Moreover, in accordance with aspects of the present subject matter, one or more route slots 100 are defined in the slat body 44 for passing an associated lift cord 28 of the covering 20 through each slat 40. For instance, as shown in the illustrated embodiment, each slat 40 includes two route slots 100 defined in its slat body 44. However, in other embodiments, each slat 40 may include any other suitable number of route slots 100 depending on the number of lift cords 28 of the associated covering 10. As shown in FIG. 3, each route slot 100 is spaced inwardly from the adjacent lateral end 46, 48 of the slat body 44 by a given lateral distance 66 in the longitudinal direction L of the slat 40. Additionally, in one embodiment, each route slot 100 may be centered or substantially centered between the first and second edges 50, 52 of the slat body 44 in the crosswise direction CW of the slat 40.

Referring particularly to FIGS. 1 and 2, in several embodiments, the lift cords 28 of the covering 20 form part of a lift system (not shown) for moving the covering 20 between a lowered or extended position (e.g., as shown in FIG. 2) and a raised or retracted position (not shown). For instance, as shown in FIGS. 1 and 2, the lift cords 28 extend between the headrail 22 and the bottom rail 24, with each lift cord 28 passing through a vertically aligned set of route slots 100 defined in the slats 40. Each lift cord 28 may then extend to one or more lift and/or control stations (not shown) to control the vertical positioning of the bottom rail 24 relative to the headrail 22. For instance, in one embodiment, the lift cords 28 may be operatively coupled to one or more lift stations housed within the bottom rail 24. In such an embodiment, by pulling down on the bottom rail 24, the covering 20 may be moved to the extended position (e.g., as shown in FIG. 1) at which the bottom rail 24 is spaced apart from the headrail 22 along the vertical height of the adjacent architectural structure. Similarly, by lifting the bottom rail 24, the covering 20 may be moved to the retracted position (not shown) at which the bottom rail 24 is positioned generally adjacent to the headrail 22, with the slats 40 being stacked vertically therebetween.

Figure 4:
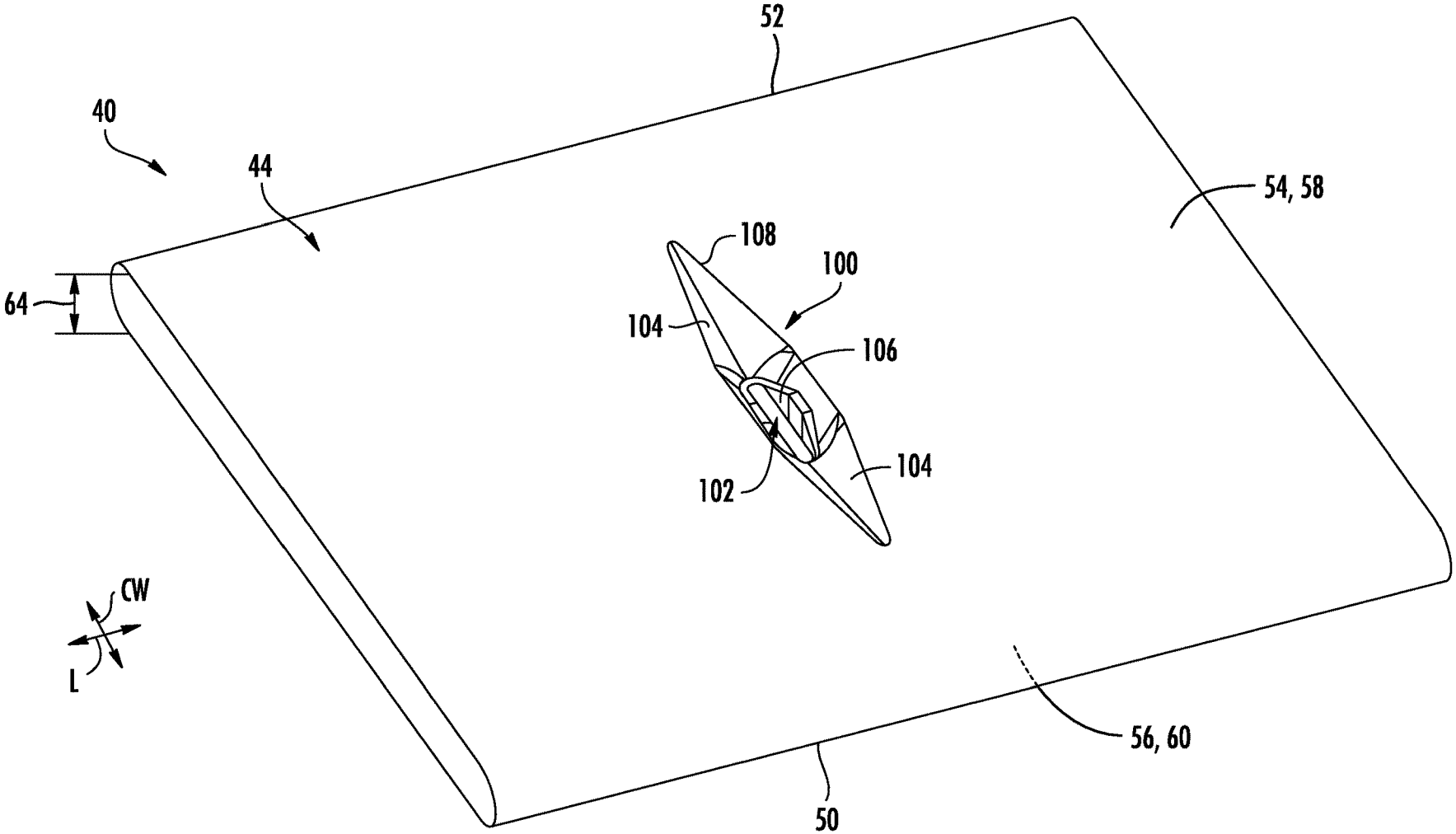
FIG. 4 illustrates a perspective view of a portion of the slat shown in FIG. 3, particularly illustrating the slat including one embodiment of a route slot defined therein in accordance with aspects of the present subject matter.
Figure 5:
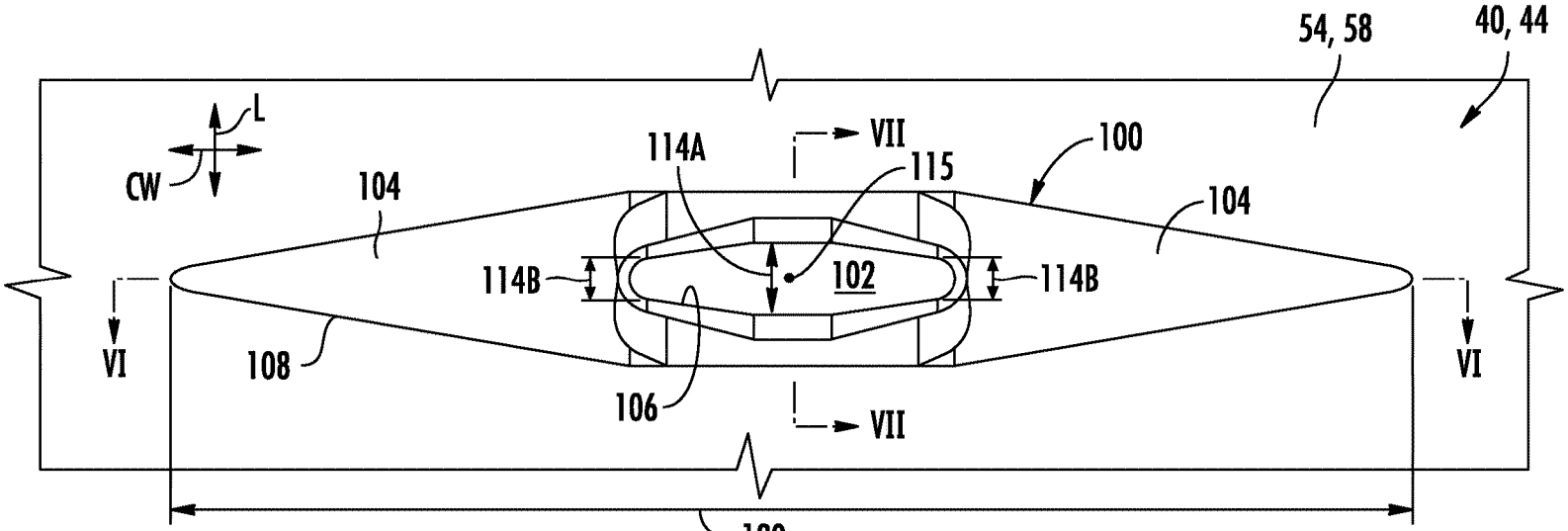
FIG. 5 illustrates a top view of the route slot shown in FIG. 4 along with a portion of the surrounding slat.
Figure 6:
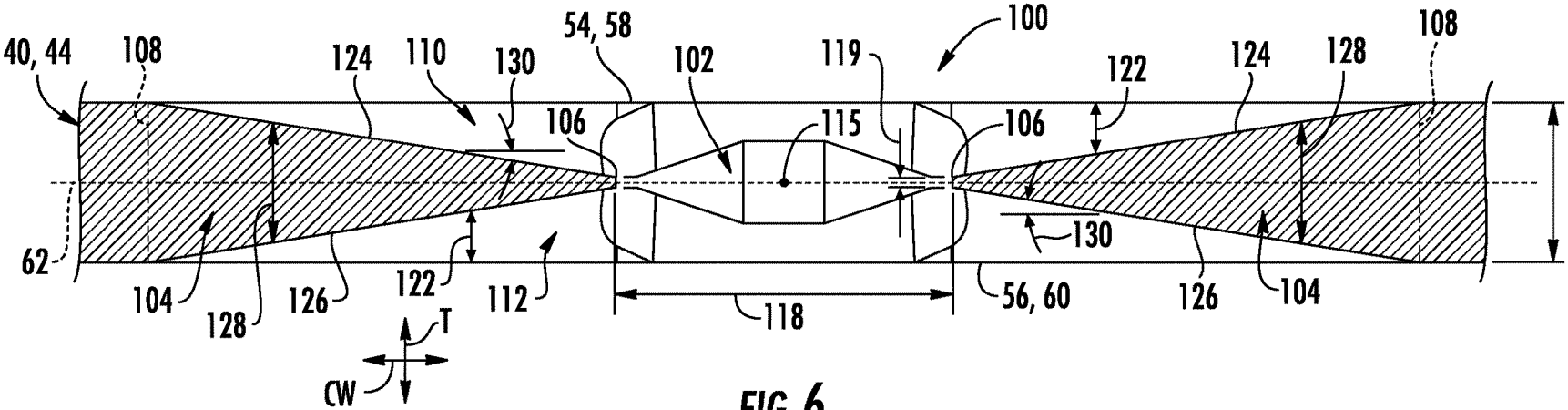
FIG. 6 illustrates a cross-sectional view of the route slot shown in FIG. 5 taken about line VI-VI.
Figure 7:
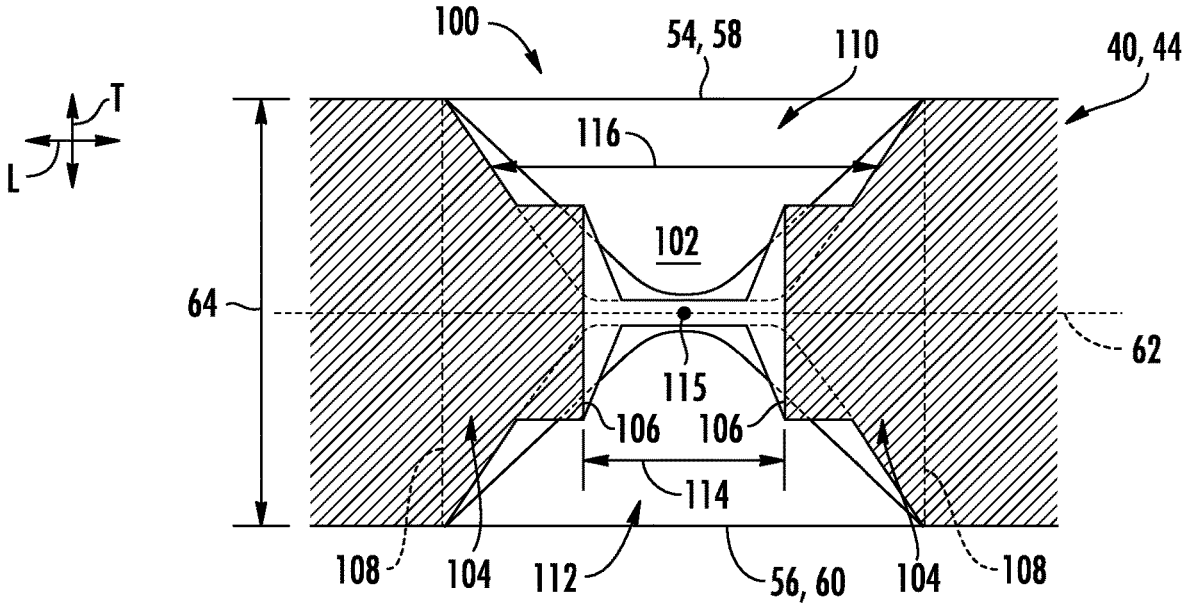
FIG. 7 illustrates another cross-sectional view of the route slot shown in FIG. 5 taken about line VII-VII.

Referring now to FIGS. 4-7, several views of one embodiment of one of the route slots 100 described above with reference to FIGS. 1-3 are illustrated in accordance with aspects of the present subject matter. Specifically, FIG. 4 illustrates a perspective view of a portion of the slat 40 shown in FIG. 3, particularly illustrating one of the route slots 100 defined therein. Additionally, FIG. 5 illustrates a top view of the route slot 100 shown in FIG. 3 and FIGS. 6 and 7 illustrate cross-sectional views of the route slot shown in FIG. 4 taken along lines VI-VI and VII-VII, respectively.

In general, the disclosed route slot 100 is configured in a manner that enhances the light control and privacy for the slat 40 while still allowing the slat 40 to be moved to its fully closed position. Specifically, in several embodiments the route slot 100 corresponds to a channel or recessed feature defined relative to the outer faces 58, 60 of the slat body 44, with the route slot 100 including a centrally-located, reduced-size through-hole 102 through which one of the lift cords 28 of the associated covering 20 passes. As will be described below, by configuring the disclosed route slot 100 in the manner described herein, the required dimensions of the through-hole 102 may be controlled primarily by the diameter of the lift cord 28 (as opposed to both the lift cord diameter and the thickness 64 of the slat 40), thereby allowing the through-hole dimensions to be significantly reduced. Specifically, in several embodiments, the dimension of the through-hole 102 in the longitudinal direction L of the slat 40 need only be large enough to accommodate the diameter of the lift cord 28 while the dimension of the through-hole 102 in the crosswise direction CW of the slat 40 need only be large enough to allow the lift cord 28 to extend through the through-hole 102 at the desired maximum tilt angle 42 for the slat 40 (while taking into account, if necessary, a thickness dimension 119 (FIG. 6) of the through-hole 102 in the thickness direction T of the slat 40). Additionally, in such embodiments, the remainder of the route slot 100 (e.g., the portions of the route slot 100 extending outwardly from and/or surrounding the through-hole 102) may be shaped or sized to provide the necessary cord clearance for achieving the desired maximum tilt angle 42. For instance, the remainder of the route slot 100 may be configured to extend outwardly from and/or surround the through-hole 102 so that portions of the remainder of the route slot 100 form recessed cord paths along the route slot 100 for receiving corresponding portions of the lift cord 28 when the slat is tilted relative to the cord 28. Thus, as compared to conventional route holes that require significantly elongated through-holes to allow the same or a similar maximum tilt angle to be achieved, the through-hole dimensions can be significantly reduced in a manner that reduces both the amount of light transmitted through the route slot 100 and the ability to see through the slats 40 (i.e., privacy), particularly the ability to see through a window from outside when it is dark and light is shining against the covering from inside the room in which the covering is installed.

In several embodiments, the route slot 100, including the associated through-hole 102, may be defined by a route wall 104 that is recessed relative to the outer faces 58, 60 of the slat body 44. For example, as shown in FIGS. 5 and 6, the route wall 104 is configured to extend radially outwardly from the through-hole 102 between an inner end 106 and an outer end (indicated by dashed line 108 in FIGS. 6 and 7), with the radially inner end 106 of the route wall 104 defining the through-hole 102 and the radially outer end 108 of the route wall 104 defining the outer perimeter of the route slot 100. In such an embodiment, the inner end 106 of the route wall 104 is recessed relative to the first and second faces 58, 60 of the slat body 44 in the thickness direction T of the slat 40 such that the through-hole 102 is defined by the route wall 104 at a location between the outer faces 58, 60 of the slat body 44 in such direction T. For instance, in one embodiment, the through-hole 102 may be defined by the recessed route wall 104 at the actual or apparent center of the thickness 64 of the slat 40. Specifically, as shown in FIG. 6, the inner end 106 of the route wall 104 terminates at a location equidistant or substantially equidistant from the first and second faces 58, 60 of the slat body 44 such that the through-hole 102 is aligned or substantially aligned with the central slat plane 62 extending through the center of the slat 40. In one embodiment, the through-hole 102 is substantially aligned with the central slat plane 62 when the through-hole 102 is offset from the central slat plane 62 in the thickness direction T by a distance that is equal to less than 20% of the thickness 64 of the slat body 44. However, in other embodiments, the through-hole 102 may be defined between the first and second faces 58, 60 of the slat body 44 in the thickness direction T at a location that is offset from the central slat plane 62 by greater than 20% of the thickness 64 of the slat body 44.

It should be appreciated that, as used herein, the radial direction generally refers to any direction extending outwardly from a center of the through-hole 102 (e.g., indicated by dot 115 in FIGS. 5 and 6) defined along a plane extending parallel to the central plane 62 of the slat 40. Thus, depending on the context in which it is being used, the radial direction may, for example, refer to a direction extending outwardly from the center 115 of the through-hole 102 along the longitudinal direction L of the slat 40, the crosswise direction CW of the slat 40, and/or any other direction that is defined between the longitudinal and crosswise directions L, CW within the plane including such directions.

In several embodiments, the recessed route wall 104 may be formed by a portion of the slat body 44. For example, as will be described later herein, the slat body 44 may be pressed, punched, machined and/or otherwise processed to form the route slot 100 within the slat body 44, with the route wall 104 corresponding to the remaining portion of the slat body 44 extending radially within the perimeter of the route slot 100. As such, in one embodiment, the route wall 104 may correspond to an integral section of the slat body 44 that remains following the formation of the route slot 100. However, in other embodiments, the route wall 104 may be formed by a separate component that is separately installed relative to the slat body 44. For instance, as will be described below with reference to FIGS. 14-16, the route wall 104 may, instead, be formed by a portion of a separate insert 580 configured to be coupled to the slat body 44 at the desired location of the route slot 100.

It should be appreciated that, with the configuration shown in the illustrated embodiment, the recessed route wall 104 may function as a light-blocking element by partially dividing or separating the route slot 100 into a first slot portion or recess 110 (FIGS. 5 and 6) defined along the first side 54 of the slat 40 and a second slot portion or recess 112 (FIGS. 5 and 6) defined along the second side 56 of the slat 40. Specifically, the first recess 110 corresponds to the portion of the route slot 100 defined in the thickness direction T of the slat 40 between the first face 58 of the slat body 44 and the through-hole/route wall 102, 104, while the second recess 112 corresponds to the portion of the route slot 100 defined in the thickness direction T between the second face 60 of the slat body 44 and the through-hole/route wall 102, 104. As such, in contrast to conventional route holes that extend through the slat body 44 along the entire hole, the route wall 104 may serve to prevent light from being transmitted through the route slot 100 along the radial sections of the first and second recesses 110, 112 defined between the inner and outer ends 106, 108 of the wall 104 and yet still provides space (i.e., via the through-hole 102) for the cord 28 to move/pass through the slot 100 during operation, with the through-hole 102 defining the only location through which light can be transmitted between the outer faces 58, 60 of the slat body 44. Additionally, in one embodiment, at least a portion of each radial section of the first and second recesses 110, 112 defined between the inner and outer ends 106, 108 of the wall 104 may form a recessed cord path for receiving a portion of the lift cord 28 when the slat 40 is tilted relative to the cord 28. As a result, such enlarged portion(s) of the first and second recesses 110, 112 (e.g., enlarged relative to the through-hole 102) may facilitate tilting of the slat 40 to its desired maximum tilt angle 42, thereby allowing the dimensions of the through-hole 102 to be reduced as compared to conventional route holes.

As indicated above, the specific dimensions of the through-hole 102, along with the overall dimensions of the route slot 100, may generally be selected based on the diameter of the associated lift cord 28 so as to minimize light transmission through the route slot 100 while allowing the slat 40 to be tilted to its desired maximum tilt angle 42. Specifically, in several embodiments, the dimension of the through-hole 102 in the longitudinal direction L of the slat 40 may be selected so as to correspond to the minimum dimension (or approximately the minimum dimension) required to allow the lift cord 28 to be received within the through-hole 102. For instance, as particularly shown in FIG. 7, the through-hole 102 defines a through-hole width 114 along the longitudinal direction L that is only slightly larger than the diameter of the lift cord 28 configured to be received therein. As such, with the associated slat 40 oriented at its maximum tilt angle 42, the lift cord 28 may substantially fill the through-hole 102 in both the crosswise and longitudinal directions CW, L of the slat 40, thereby eliminating or minimizing any gaps defined in the longitudinal direction L between the lift cord 28 and the inner end 106 of the route wall 104.

As particularly shown in FIG. 5, in one embodiment, the width 114 (FIG. 7) defined by the through-hole 102 tapers slightly as the through-hole 102 extends in the crosswise direction CW of the slat 40 from its center 115 such that the through-hole 102 defines a maximum width 114A at the location of its center 115 and a slightly reduced width 114B at its opposed crosswise ends. Such a tapered crosswise width profile may, for example, be provided to accommodate an associated cord threading tool used to thread the lift cord 28 through aligned sets of route slots 100 defined in the slats 40.

Moreover, as shown in FIG. 7, the route slot 100 also defines an overall slot width 116 along the longitudinal direction L of the slat 40. In one embodiment, the slot width 116 defined by the route slot 100 may be varied relative to the through-hole width 114 defined by the through-hole 102, such as by configuring the first and second recesses 110, 112 to define slot widths 116 that are greater than the through-hole width 114 of the through-hole 102. For instance, as shown in FIG. 7, the route wall 104 diverges outwardly from the through-hole 102 as it extends in the longitudinal direction L from its radially inner end 106 to its radially outer end 108 along each longitudinal side of the through-hole 102. As such, the slot width 116 generally increases along each longitudinal side of the through-hole 102 as the first and second recesses 110, 112 of the route slot 100 extend outwardly in the thickness direction T from the through-hole 102 towards the first and second faces 58, 60 of the slat body 44, respectively. In such an embodiment, the first and second recesses 110, 112 of the route slot 100 may be configured to be enlarged relative to the through-hole 102 in the longitudinal direction L of the slat 40. However, in other embodiments, the slot width 116 defined by the route slot 100 may be substantially equal to the through-hole width 114. In such an embodiment, the route wall 104 may only be configured to extend radially outwardly from the through-hole 102 along the crosswise direction CW of the slat 40.

Additionally, in several embodiments, the crosswise dimensions of both the outer perimeter of the route slot 100 and the associated through-hole 102 may be selected to correspond to the minimum dimensions (or approximately the minimum dimensions) required to allow the slat 40 to be tilted to the desired maximum tilt angle 42. For example, as shown in FIG. 6, the through-hole 102 of the route slot 100, in one embodiment, defines a through-hole length 118 along the cross-wise direction CW that is equal to or slightly larger than the actual length required (based at least in part on the cord diameter) to allow the lift cord 28 to pass through the through-hole 102 at the desired maximum tilt angle 42 relative to slat 40. Similarly, as shown in FIG. 5, the route slot 100, in one embodiment, defines an overall slot length 120 along the cross-wise direction CW of the slat 40 that is equal to or slightly larger than the actual length required to allow the slat 40 to be tilted to the desired maximum tilt angle 42 as the lift cord 28 extends through the route slot 100 between the outer faces 58, 60 of the slat 40. Specifically, in several embodiments, the overall slot length 120 of the route slot 100 may be selected to be greater than the through-hole length 118 by a given magnitude such that the portions of the first and second recesses 110, 112 extending in the cross-wise direction CW between the inner and outer ends 106, 108 of the route wall 104 (i.e., the portions of the recesses 110, 112 extending outwardly from the perimeter of the through-hole 102 defined at the inner end 106 of the route wall 104) are configured to accommodate or otherwise receive portions of the lift cord 28 when the slat is tilted to its maximum tilt angle 42 and the cord is extending through the through-hole 102.

It should be appreciated that, in one embodiment, the through-hole length 118 of the through-hole 102 in the cross-wise direction CW may be selected based on both the cord diameter of the lift cord 28 and a thickness dimension 119 (FIG. 6) of the through-hole length 118 defined in the thickness direction T of the slat 40. Specifically, the thickness dimension 119 of the through-hole 102 at each cross-wise end of the through-hole 102 may impact the through-hole length 118 required to allow the lift cord 28 to pass through the through-hole 102 at the desired maximum tilt angle 42 relative to slat 40. In addition, various other parameters, including, but not limited to, the compressibility of the lift cord 28, the surface smoothness and/or the coefficient of friction of the lift cord 28, and/or the surface smoothness and/or the coefficient of friction of the inner wall of the through-hole 102, may be considered when selecting the through-hole length 118 of the through-hole 102. For example, the compression of the lift cord 28 may be relied upon to account for all or a portion of the thickness dimension 119 of the through-hole length 118 in the thickness direction T, in which case the through-hole length 118 may, for instance, be selected based primarily on the cord diameter.

It should also be appreciated that, in several embodiments, the cross-sectional area of each recess 110, 112 defined along a plane extending parallel to the central slat plane 62 of the slat body 44 may be greater than the cross-sectional area of the through-hole 102 defined along the same plane. For instance, as shown in FIGS. 5-7, the recesses 110, 112 are enlarged relative to the through-hole 102 such that the cross-sectional area of each recess 110, 112 along the plane defined at the interface between such recess 110, 112 and the adjacent outer face 58, 60 of the slat body 44 is greater than the cross-sectional area of the through-hole 102 defined along the central slat plane 62. Specifically, as shown in the view of FIG. 5, the recesses 110, 112 are enlarged relative to the through-hole 102 in both the longitudinal direction L and/or the cross-wise direction CW of the slat 40 such that each recess 110, 112 generally surrounds or otherwise extends outwardly from the through-hole 102 in both directions.

Moreover, the configuration of the route slot 100 in the thickness direction T may also be selected to allow the slat 40 to be moved to the closed position as the lift cord 28 extends through the route slot 100, thereby allowing for the desired light control and privacy. Specifically, in several embodiments, the dimensions of the route slot 100 in the thickness direction T of the slat 40 may be selected to provide the necessary cord clearance for achieving the desired maximum tilt angle 42 for the slat 40. For example, in one embodiment, the first and second slots portions 110, 112 of the route slot 100 may define, at the very least, a minimum depth profile along the crosswise direction CW of the slat 40 to allow the lift cord 28 to be oriented within the route slot 100 at the desired maximum tilt angle 42 of the slat 40. For instance, as shown in FIG. 6, each of the first and second recesses 110, 112 defines a depth 122 that increases as the route slot 100 extends in the crosswise direction CW from its outer perimeter towards the center 115 of the through-hole 102. In such embodiments, by selecting the depth 122 based on the desired tilting performance of the slat 40, the portions of the recesses 110, 112 extending in the crosswise direction CW from the outer perimeter of the slot 100 to perimeter of the through-hole 102 defined at the inner end 106 of the route wall 104 may function as or otherwise form recessed cord paths for receiving portions of the lift cord 28 when the slat 40 is tilted relative to the cord 28. Specifically, in one embodiment, the tapered depth 122 of the first and second recesses 110, 112 relative to the outer faces 58, 60 of the slat 40 may be selected to allow the route slot 100 to accommodate the lift cord 28 with the slat 40 oriented at its desired maximum tilt angle 42.

In several embodiments, to provide the illustrated depth profile for the route slot 100 shown in FIG. 6, the route wall 104 is configured to define a tapered profile as it extends along the cross-wise direction CW of the slat 40. Specifically, as shown in FIG. 6, the route wall 104 defines first and second inwardly sloped outer surfaces 124, 126 relative to the outer faces 58, 60 of the slat 40 that extend along the crosswise direction CW such that a thickness 128 of the route wall 104 progressively decreases as the route wall 104 extends from its outer end 108 to its inner end 106. As such, the depth 122 of the first and second recesses 110, 112 of the route slot 100 may progressively increase as the route slot 100 extends radially inwardly from its outer perimeter to the through-hole 102. As shown in FIG. 6, the first and second sloped surfaces 124, 126 define a taper angle 130 relative to the first and second faces 58, 60 of the slat body 44, respectively, as each sloped surface 124, 126 extends from the outer end 108 of the route wall 104 to the inner end 106 of the route wall 104. In such an embodiment, the taper angle 130 of the sloped surfaces 124, 126 may be equal to or greater than the desired maximum tilt angle 42 for the slat 40 to provide the desired cord clearance for the lift cord 28 when the slat 40 is moved to such tilt angle 42.

Figure 8:
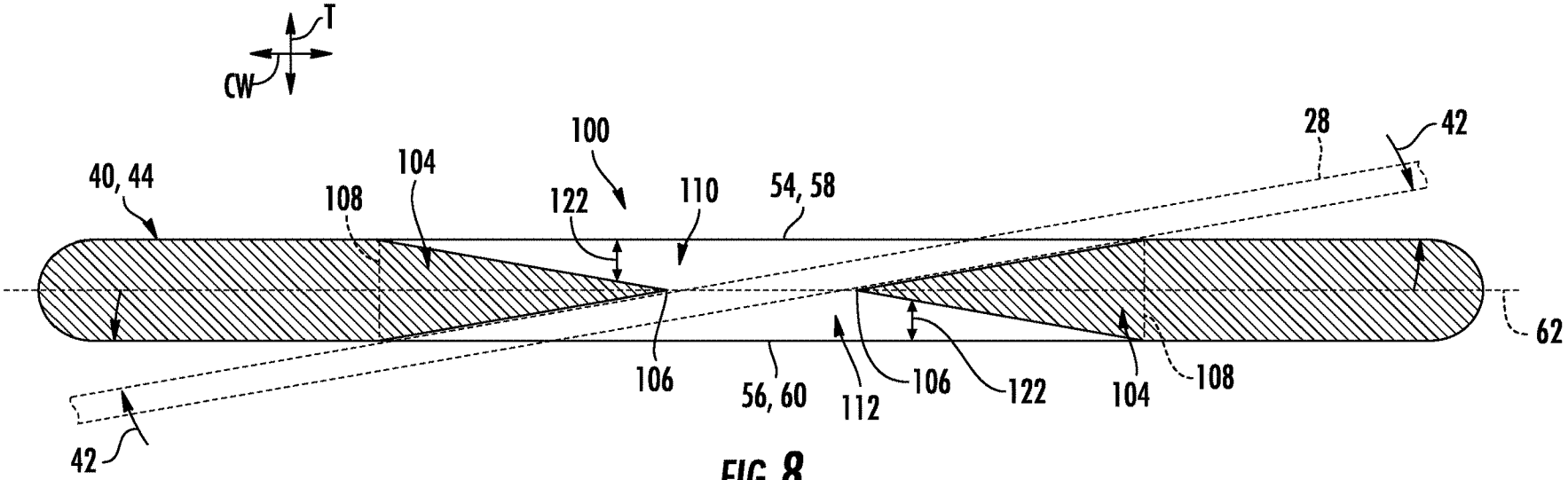
FIG. 8 illustrates a similar cross-sectional view of the route slot shown in FIG. 6 with a lift cord shown in phantom extending through the route slot at the desired maximum tilt angle relative to the slat in accordance with aspects of the present subject matter.

For instance, FIG. 8 illustrates a similar cross-sectional view of the slat 40 as that shown in FIG. 6 with a lift cord 28 (indicated by phantom lines) extending through the route slot 100 when the slat 40 is oriented at the desired maximum tilt angle 42 relative to the cord 28. As shown in FIG. 8, when the taper angle 130 (FIG. 6) of the sloped surfaces 124, 126 is equal to the maximum tilt angle 42 for the slat 40, the first and second recesses 110, 112 define the minimum required depth profile along the crosswise direction CW of the slat 40 for accommodating the cord 28 at the maximum tilt angle 42. Specifically, as shown, the lift cord 28 generally contacts or otherwise extends parallel to the adjacent sloped surfaces 124, 126 of the route wall 104 when the slat 40 is at the maximum tilt angle 42. As indicated above, in such instance, the portions of the recesses 110, 112 extending in the crosswise direction CW from the outer perimeter of the slot 100 to the perimeter of the through-hole 102 defined at the inner end 106 of the route wall 104 may function as or otherwise form recessed cord paths along which portions of the lift cord 28 pass For instance, as shown in the view of FIG. 8, the right side of the first recess 110 defines a first recessed cord path through the slat body 44 along which a corresponding portion or section of the lift cord 28 passes, while the left side of the second recess 112 defines a second recessed cord path through the slat body 44 along which another portion or section of the lift cord 28 passes. Of course, in the event that the slat 40 is tilted in the opposite direction to its maximum tilt angle, the opposed sides of the recesses 110, 112 may define respective cord paths along which corresponding portions of the lift cord extend as it passes through the slat body 44. As indicated above, in alternative embodiments, the taper angle 130 of the sloped surfaces 124, 126 may differ from the maximum tilt angle 42 for the slat 40, such as by being greater than the maximum tilt angle 42 for the slat 40.

Figure 9:
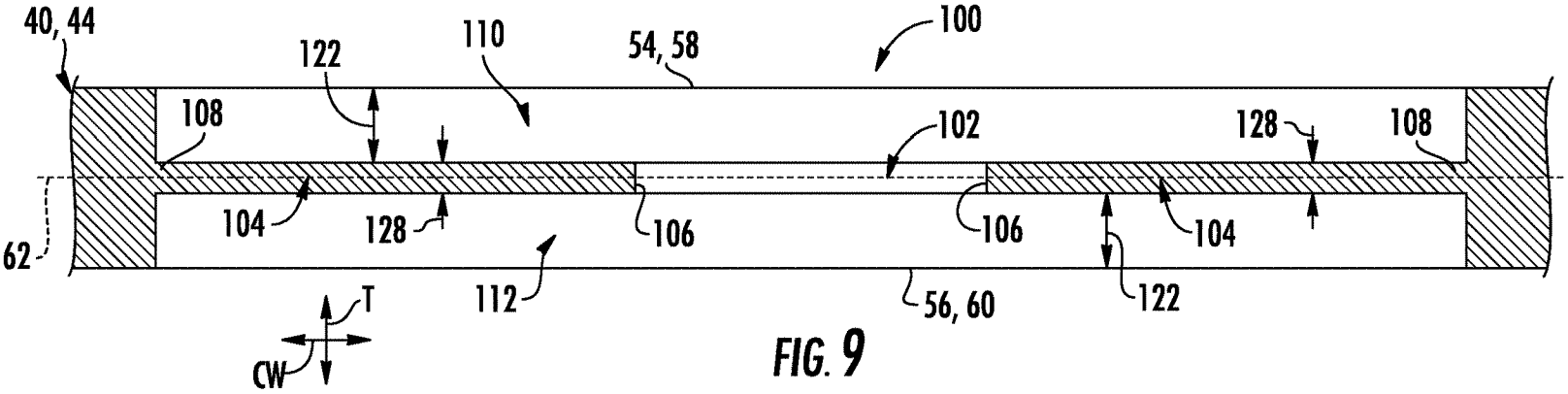
FIG. 9 illustrates a cross-sectional view of another embodiment of the route slot shown in FIGS. 4-8 in accordance with aspects of the present subject matter, particularly illustrating a similar crosswise cross-sectional view of the route slot as that shown in FIG. 6.

Moreover, in other embodiments, the route slot 100 may be configured to define any other suitable depth profile along the crosswise direction CW of the slat 40 that provides sufficient cord clearance for passing the lift cord 28 through the route slot 100 when the slat 40 is oriented at the desired maximum tilt angle 42 relative to the cord 28. For instance, FIG. 9 illustrates a cross-sectional view of another embodiment of the disclosed route slot 100 in which the route wall 104 corresponds to a planar, thin web having a substantially constant thickness 128 as the route wall 104 extends from its outer end 108 to its inner end 106. In such an embodiment, the route slot 100 may define a substantially uniform depth profile between its outer perimeter and the through-hole 102, with each of the first and second recesses 110, 112 defining a substantially constant depth 122 relative to the opposed first and second faces 58, 60 of the slat body 44, respectively.

As indicated above, the disclosed route slot may generally be formed within the slat body 44 of a given slat 40 using any suitable manufacturing technique or process known in the art. Specifically, in several embodiments, a manufacturing technique(s) may be used that relies on separate portions of the disclosed route slot being formed using separate manufacturing components and/or via separate processing steps. For example, in one embodiment, the first and second recesses 110, 112 of the route slot 100 may be formed via a die assembly (e.g., by compressing slat material to form the recessed route wall 104) prior to or simultaneously with a punch being used to form the through-hole 102. In another embodiment, separate cuts may be made along each side of the slat 40 to separately form the first and second recesses 110, 112 of the route slot 100. In such an embodiment, each cut may, for example, also form a portion of the through-hole 102 or a separate process may be utilized to form the through-hole 102 following the formation of each recess 110, 112 along each side of the slat 40.

Figure 10A:
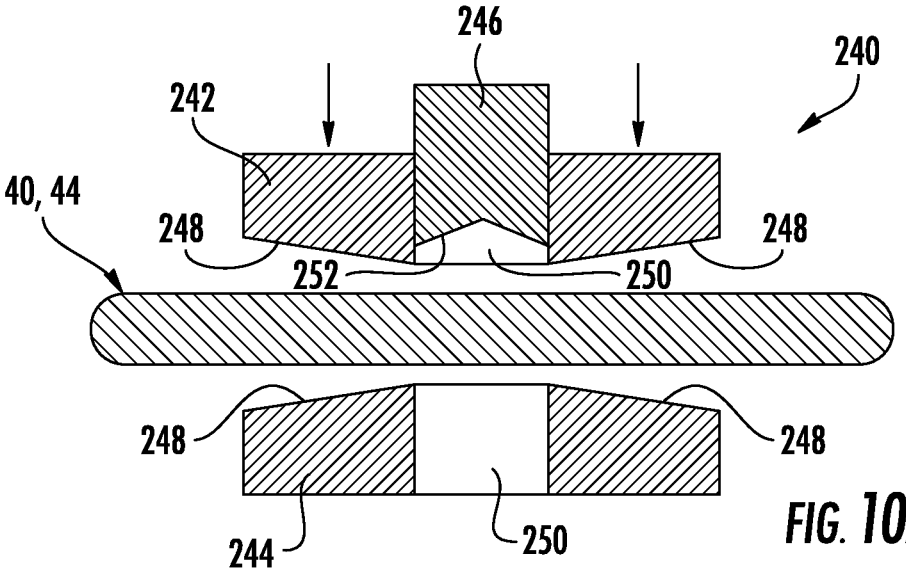
FIG. 10A illustrates a simplified, cross-sectional view of one embodiment of a die assembly that may be used to form an embodiment of the disclosed route slot in accordance with aspects of the present subject matter, particularly illustrating a slat positioned between an upper die and a lower die of the die assembly.
Figure 10B:
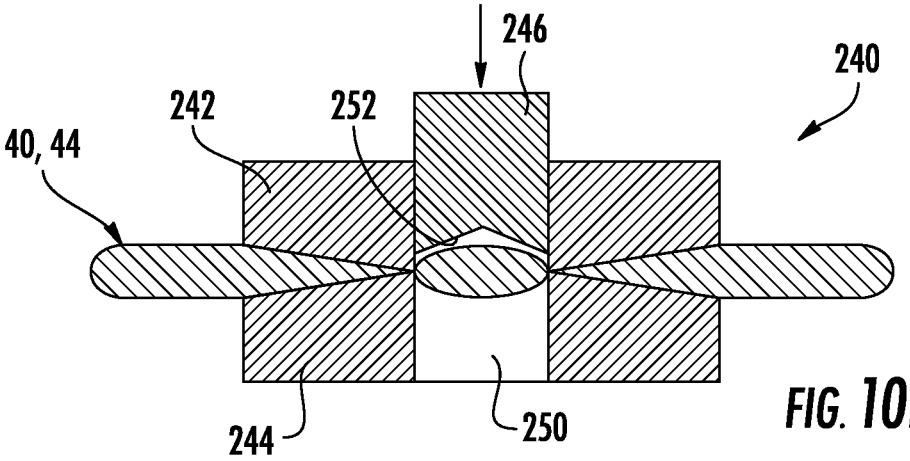
FIG. 10B illustrates another simplified, cross-sectional view of the die assembly shown in FIG. 10A, particularly illustrating the slat compressed between the upper and lower dies.
Figure 10C:
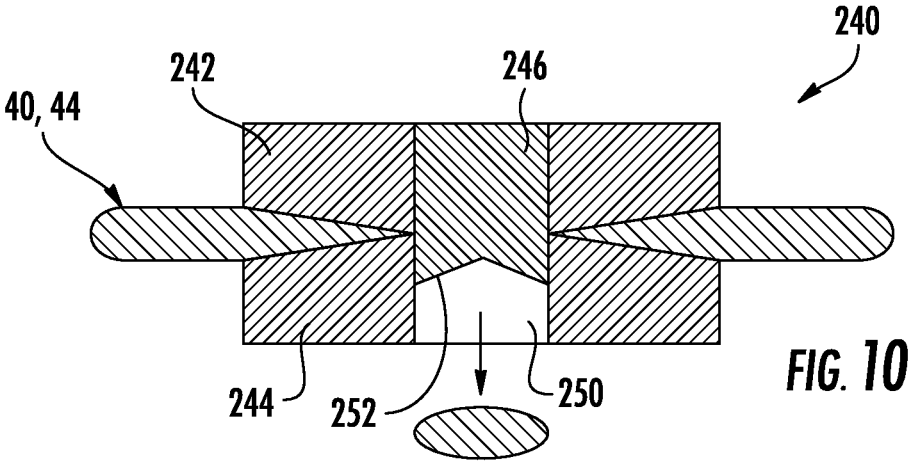
FIG. 10C illustrates yet another simplified, cross-sectional view of the die assembly shown in FIG. 10A, particularly illustrating a punch of the die assembly actuated relative to the upper and lower dies to punch a through-hole as the slat is compressed between the upper and lower dies.

For instance, FIGS. 10A-10C illustrate one embodiment of a die-assembly 240 that may be used to form a route slot 100 within a slat 40 using a single stroke, two-stage embossing punch process. For purposes of description, the die-assembly 240 is shown as being configured to form the route slot 100 described above with reference to FIGS. 4-8. However, in other embodiments, the die assembly 240 may be configured to form a route slot having any other suitable configuration consistent with the disclosed provided herein.

As shown in FIGS. 10A-10C, the die assembly 240 includes upper and lower embossing dies 242, 244 configured to emboss or compress a portion of the slat body 44 positioned at the desired location of the route slot 100 to form the recessed route wall 104 (and, thus, the first and second recesses 110, 112 of the slot 100) and a separate punch 246 configured to punch-out the remaining slat material extending radially within the compressed portion of the slat body 44 to form the through-hole 102 the slot 100. In such an embodiment, the embossing or work surfaces 248 of the upper and lower dies 242, 244 may be configured to collectively define a profile that matches the desired profile of the route slot 100. As such, when the slat body 44 is compressed between the upper and lower dies 242, 244, the route slot 100 may be formed in the slat body 44, with the remaining, compressed portion of the slat body 44 forming the recessed route wall 104. For example, as shown in the illustrated embodiment, the upper and lower dies 242, 244 include angled work surfaces 248 that match the profiles of the corresponding sloped surfaces 124, 126 (FIG. 6) of the route wall 104.

Additionally, as shown in FIGS. 10A-10C, the upper and lower dies 242, 244 define aligned punch openings 250 for receiving the punch 246 of the die assembly 240. Specifically, in several embodiments, the punch 246 may be configured to be slidably received within the aligned openings 250 to allow the punch 246 to be moved or actuated relative to the dies 242, 244 during the second stage of the two-stage embossing punch process. For example, as shown in FIGS. 10A and 10B, the punch 246 is initially retained in the punch opening 250 defined by the upper die 242 such that a cutting face 252 of the punch 246 is positioned above the slat body 44 as the dies 242, 244 are used to compress the slat body 44. Once the slat body 44 is fully compressed between the upper and lower dies 242, 244, the punch 246 may then be actuated relative to the dies 242, 244 to allow the punch 246 to form the through-hole 102 of the route slot 100. For instance, as shown in FIG. 10C, the punch 246 is actuated relative to the embossing dies 242, 244 such that the cutting face 252 of the punch 246 "punches through" the portion of the slat body 44 positioned at the desired location of the through-hole 102 and is received within a portion of the punch opening 250 of the lower die 244.

By forming the route slot 100 using the above-described die assembly 240, the dies 242, 244 may be used to compress the slat material and hold the slat body 44 in advance of the through-hole punch. As such, when the punch 246 is subsequently actuated relative to the embossing dies 242, 244 to form the through-hole 102, the surrounding slat material may be clamped in place, thereby preventing material spring-back during the punching stage. Additionally, as indicated above, the two-stage embossing punch process may be implemented via a single stroke of the actuator (not shown) configured to actuate or otherwise move the movable components of the die assembly 240. For example, a suitable fixture may be designed that allows the actuation of the punch 246 to be delayed until the upper and lower dies 242, 244 have been compressed together to perform the initial embossing stage of the process. Thereafter, the remainder of the stroke of the actuator may be used to actuate the punch 246 relative to the dies 242, 244 to perform the punching stage of the process and complete the formation of the route slot 100.

Figure 11A:
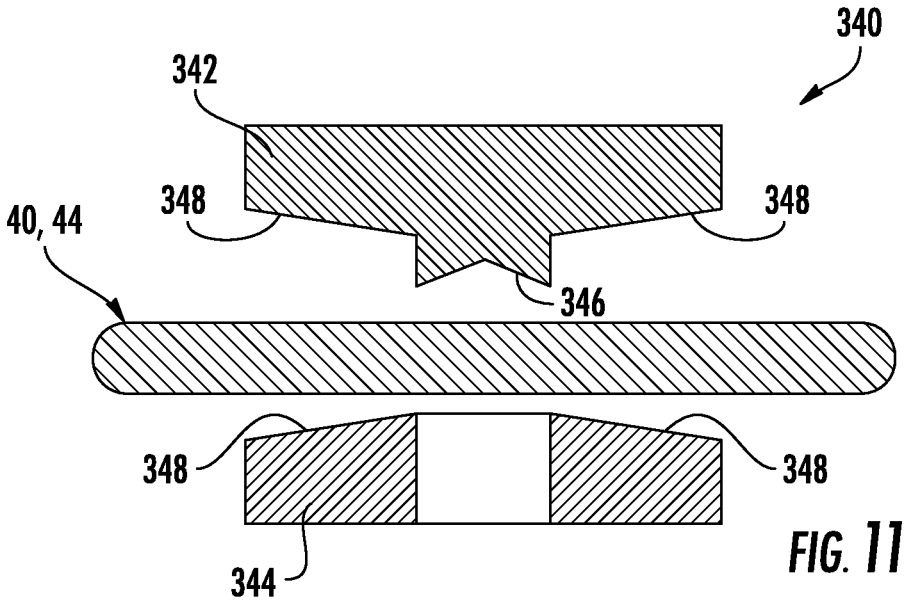
FIG. 11A illustrates a simplified, cross-sectional view of another embodiment of a die assembly that may be used to form an embodiment of the disclosed route slot in accordance with aspects of the present subject matter, particularly illustrating a slat positioned between an upper die and a lower die of the die assembly.
Figure 11B:
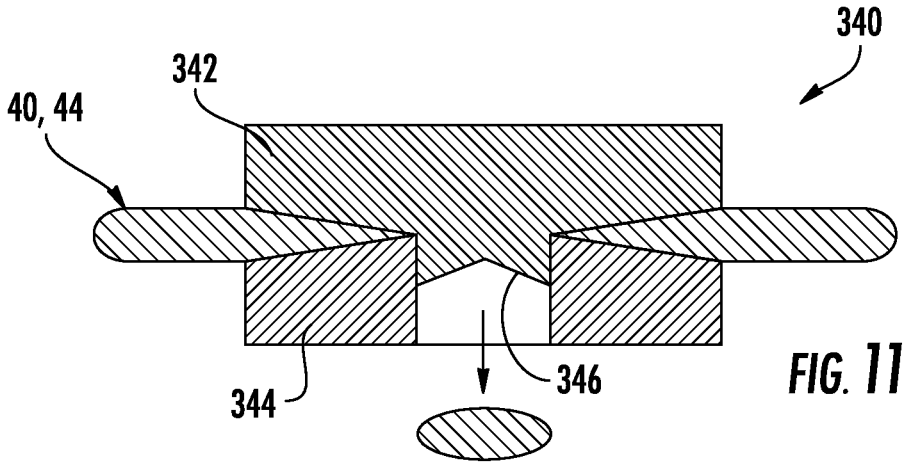
FIG. 11B illustrates another simplified, cross-sectional view of the die assembly shown in FIG. 11A, particularly illustrating a punch associated with the upper die being used to punch a through-hole as the slat is being compressed between the upper and lower dies.

It should be appreciated that, as an alternative to the two-stage embossing punch process described above, the disclosed route slots may be formed using a single-stage embossing punch process. For example, FIGS. 11A and 11B illustrate another embodiment of a die-assembly 340 that may be used to form the route slot 100 described above with reference to FIGS. 4-8 using a single-stage embossing punch process. As shown in FIGS. 11A and 11B, the die assembly 340 may be configured similar to the die assembly 240 described above. For instance, the die assembly 340 includes upper and lower embossing dies 342, 344 configured to emboss or compress a portion of the slat body 44 positioned at the desired location of the route slot 100 to form the recessed route wall 104 (and, thus, the slot 100). However, unlike the die assembly 240 described above, the die assembly 340 includes a punch 346 that is fixed relative to the embossing dies 342, 344, such as by forming the punch 346 integrally with one of the dies 342, 344 (e.g., the upper die 342) or by rigidly coupling the punch 346 to one of the dies 342, 344. In such an embodiment, the through-hole 102 may be punched through the slat body 44 via the fixed punch 346 as the surrounding portions of the slat 40 are being compressed between the work surfaces 348 of the embossing dies 342, 344.

Figure 12:
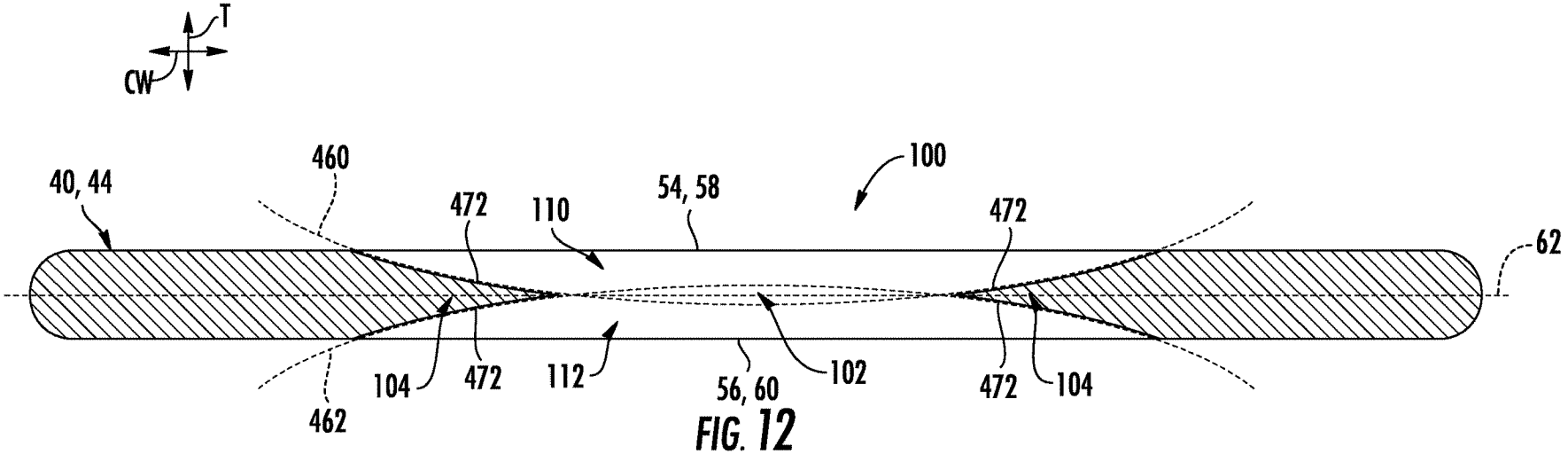
FIG. 12 illustrates a cross-sectional view of a slat having a route slot formed therein, particularly illustrating one embodiment of opposed saw cuts that may be used to form the route slot within the slat in accordance with aspects of the present subject matter.

As opposed to a punching process, the disclosed route slot may be formed using any suitable machining process that allows material to be removed from the slat body 44. For instance, in several embodiments, each side 54, 56 of the slat body 44 may be machined using one or more cutting devices (e.g., one or more saws, such as one or more rotary saws) configured to remove material from the slat body 44 to form the route slot. In such embodiments, the depths of the cuts made by the cutting device(s) along each side 54, 56 of the slat body 44 may be selected such that the through-hole of the disclosed route slot is formed directly by the cuts or via a subsequent secondary operation. For example, FIG. 12 illustrates a cross-sectional view of a slat 40 in which a route slot 100 has been formed therein using overlapping rotary saw cuts along each side 54, 56 of the slat body 44. As shown, a first saw cut (indicated by curved dashed line 460 representing a portion of the outer circumference of the saw blade as well as the depth of the cut made via the saw) may be made along the first side 54 of the slat body 44 to form the first recesses 110 of the route slot 100 while a second saw cut (indicated by curved dashed line 462 representing a portion of the outer circumference of the saw blade as well as the depth of the cut made via the saw) may be made along the second side 56 of the slat body 44 to form the second recesses 112 of the route slot 100. In such an embodiment, given that the first and second saw cuts 460, 462 overlap each other along the central plane (not shown) of the slat 40, the overlapping cuts 460, 462 may also form the through-hole 102 of the route slot 100, thereby allowing the entire route slot 100 to be machined via the saw cuts 460, 462.

Figure 13A:
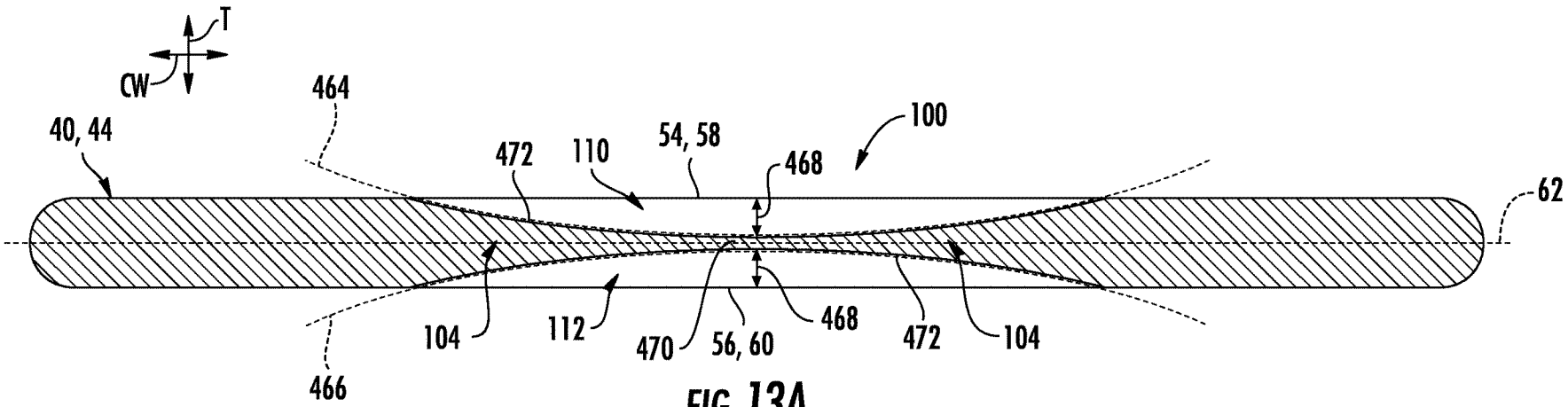
FIG. 13A illustrates another cross-sectional view of a slat having a route slot formed therein, particularly illustrating a further embodiment of opposed saw cuts that may be used to form the route slot within the slat in accordance with aspects of the present subject matter.
Figure 13B:
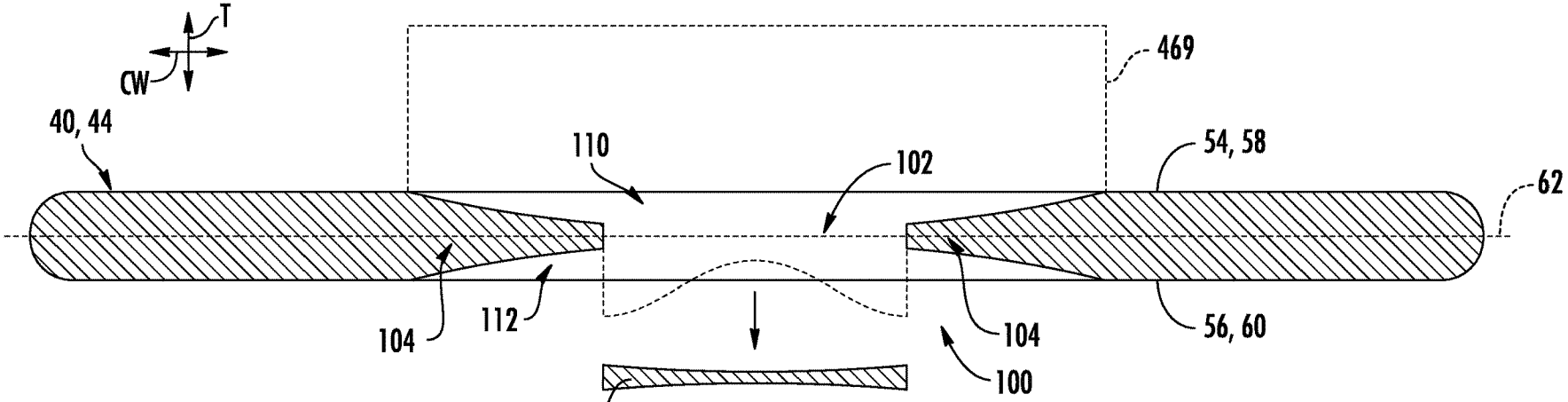
FIG. 13B illustrates another cross-sectional view of the slat shown in FIG. 13B, particularly illustrating a secondary operation being performed on the slat to form a through-hole therein.

Alternatively, FIG. 13A illustrates a cross-sectional view of a slat 40 in which a route slot 100 has been formed therein using non-overlapping rotary saw cuts along each side 54, 56 of the slat body 44. As shown, a first saw cut (indicated by curved dashed line 464 representing a portion of the outer circumference of the saw blade as well as the depth of the cut made via the saw) may be made along the first side 54 of the slat body 44 to form the first recess 110 of the route slot 100 while a second saw cut (indicated by curved dashed line 466 representing a portion of the outer circumference of the saw blade as well as the depth of the cut made via the saw) may be made along the second side 56 of the slat body 44 to form the second recess 112 of the route slot 100. However, unlike the embodiment described above with reference to FIG. 12, each saw cut 464, 466 is made to a depth 468 into the slat body 44 spaced apart from the central plane (not shown) of the slat 40 such that a portion 470 of the slat material remains at the desired location of the through-hole. In such an embodiment, a secondary operation may be performed following the saw cuts 464, 466 to form the through-hole of the route slot 100. For instance, as shown in FIG. 13B, a secondary punch operation may be performed using a suitable die assembly and/or punch 469 (shown in dashed lines) to punch-out the remaining slat material 470 to form the through-hole 102.

It should be appreciated that, when the route slot 100 is formed using one of the above-described machine cutting processes, the first and second recesses 110, 112 of the route slot 100 may define non-linear depth profiles as each recess 110, 112 extends in the crosswise direction CW of the slat 40 between the outer perimeter of the route slot 100 and the associated through-hole 102. For instance, as shown in FIGS. 12 and 13A, unlike the planer, sloped surfaces 124, 126 described above with reference to FIG. 6, the resulting recessed route wall 104 includes arcuate or curved wall surfaces 472 extending along the crosswise direction CW of the slat 40.

Additionally, it should be appreciated that, as an alternative to the manufacturing methods described above, any other suitable manufacturing method or process may be used to form the disclosed route slot within a slat. It should also be appreciated that, as indicated above, the specific manufacturing method used to form the disclosed route slots may be varied or selected based on the material of the slats being processed. For instance, malleable materials, such as plastic materials, are often better suited for being compressed via a die assembly than non-malleable materials, such as wood and other rigid materials (including coating materials applied to the exterior of slats). Similarly, when using cutting device(s), materials with relatively low melting or plastic temperatures, such as plastics or other polymer materials, may tend to heat up during the cutting process and melt at the interface between the slat and the cutting device(s), thereby resulting in undesirable material accumulation along the formed route slot (e.g., often along the exit side of the cutting device(s)). Thus, in one embodiment, for a faux wood slat (e.g., a slat formed from polyvinyl chloride (PVC), polystyrene (PS), or any other suitable plastic material), it may be desirable to utilize one of the embossing punch processes to form the route slot therein. Similarly, in one embodiment, for a wood slat, it may be desirable to remove material from the slat to form the route slot (e.g., using saws or other cutting devices).

However, in other embodiments, a given manufacturing technique may be used to form the disclosed route slots regardless of the material used to form the slats. For instance, when forming a route slot using the cutting process described above in which separate saw cuts are made along each side of the slat, the saws may be rotated in reverse relative to their intended rotational direction such that each saw blade has a reverse or negative rake as it is passed through the slat material. Such reverse rotation of the saws has, for example, has been found to provide acceptable results across a wide range of slat materials, including both plastic materials and wood. It should be appreciated that, as an alternative to reversing the rotation of conventional positive rake saw blades, the disclosed cutting process may, instead, be implemented using saw blades intentionally designed to have a negative rake.

Figure 14:
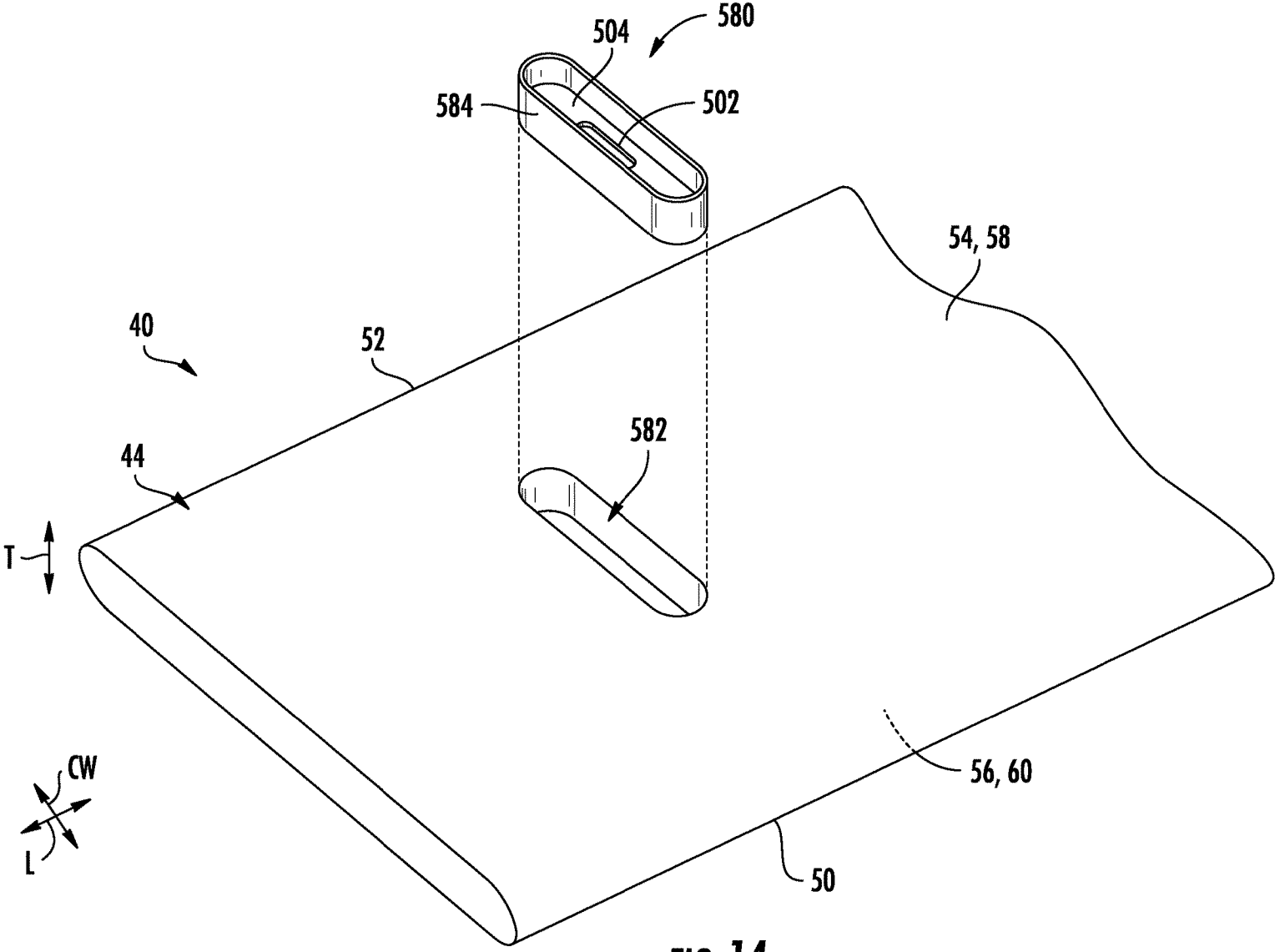
FIG. 14 illustrates an exploded view of one embodiment of a slat configured to receive a separate insert for forming a route slot therein in accordance with aspects of the present subject matter.
Figure 15:
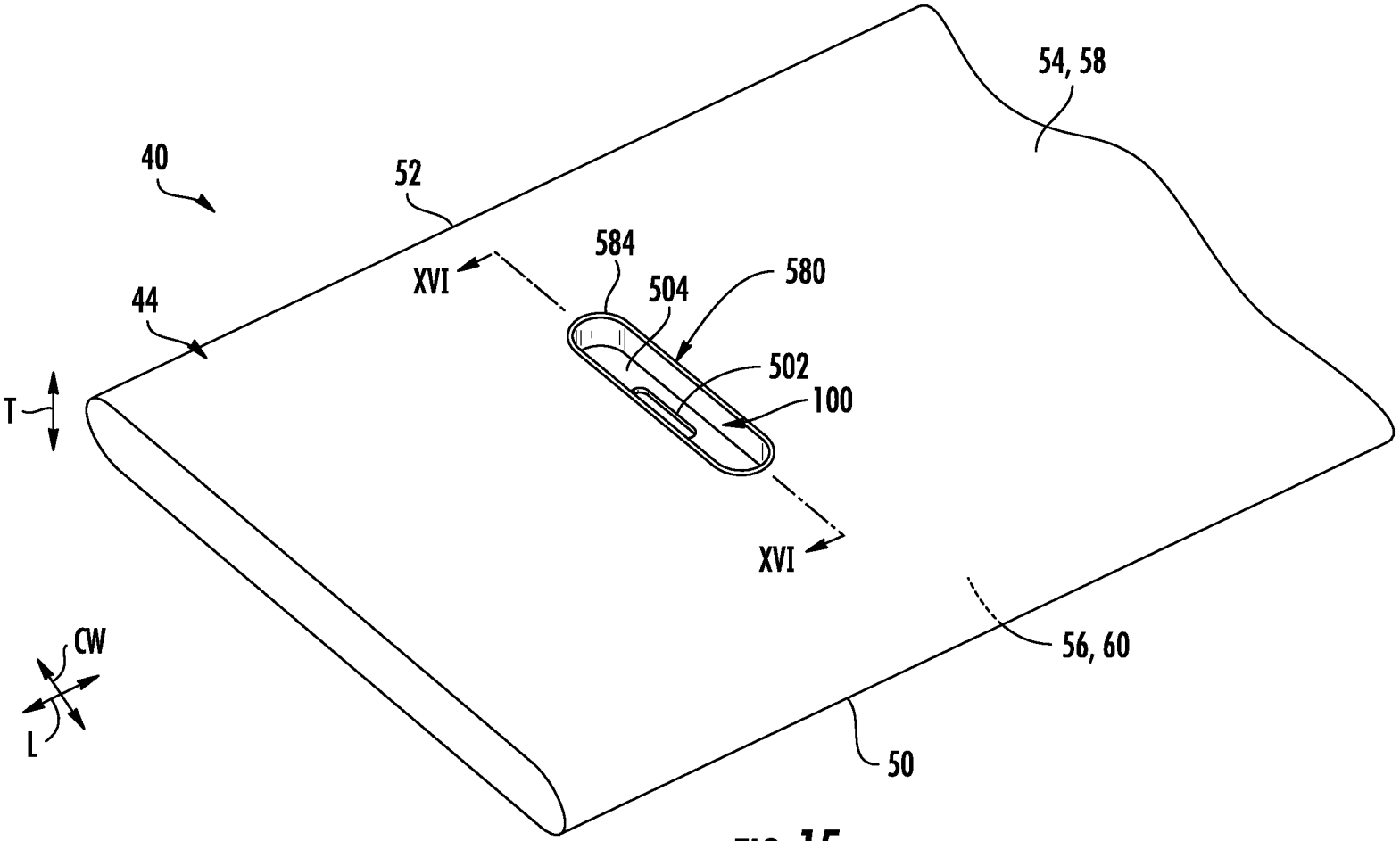
FIG. 15 illustrates an assembled view of the slat and the insert shown in FIG. 14.

Moreover, in yet another embodiment of the present subject matter, the disclosed route slot may be formed at least partially by a separate insert configured to be installed relative to the associated slot. For example, FIGS. 14 and 15 illustrate respective exploded and assembled views of a slat 40 configured to include a route slot 100 (FIG. 15) defined at least partially by a separate insert 580 configured to be installed relative to the slat body 44. Additionally, FIG. 16 illustrates a cross-sectional view of the slat 40 shown in FIG. 15 taken about line XVI-XVI.

As shown, to accommodate the insert 580, an elongated opening 582 (FIG. 14) may be initially defined in the slat body 44 at the desired location of the route slot 100. In such an embodiment, the dimensions of the opening 582 may generally be selected so as to allow the insert 580 to be received within the opening and retained therein relative to the slat 40. As shown in FIG. 14, in one embodiment, the elongated opening 582 defines a similar shape and/or size as a conventional route hole, such as an elongated oval shape or a rectangular shape with rounded-off ends. Additionally, depending on the required dimensions of the resulting route slot 100, the elongated opening 582 may, in one embodiment, simply correspond to a pre-existing route hole of a conventional slat, thereby allowing the disclosed insert 580 to be installed as a retrofit solution for improving the light control and privacy of existing slats.

Additionally, as shown in the illustrated embodiment, the insert 580 may generally have any suitable configuration that allows it to be installed relative to the slat body 44 such that, when the insert 580 is received within the elongated opening 582, the insert 580 (either alone or in combination with the portion of the slat body 44 forming the opening 582) defines a recessed route slut 100 (FIGS. 15 and 16) configured in accordance with aspects of the present subject matter. For example, as shown in FIGS. 14-16, the insert includes a central aperture 502 defined by a corresponding insert wall 504 extending radially outwardly therefrom. In such an embodiment, the central aperture 502 of the insert 580 may generally function as the through-hole of the route slot 100 while the insert wall 504 may generally function as the corresponding route wall. For example, as particularly shown in FIG. 16, when the insert 580 is installed relative to the slat body 44, the central aperture 502 of the insert 580 is aligned or substantially aligned with the central slat plane 62 of the slat 40, with the insert wall 504 extending radially outwardly from the central aperture 502 so as to divide the remainder of the route slot 100 into a first slot portion or recess 110 extending in the thickness direction T of the slat 40 between the insert wall 504 and the first face 58 of the slat body 44 and a second slot portion or recess 112 extending in the thickness direction T between the insert wall 504 and the second face 60 of the slat body 44.

Figure 16:
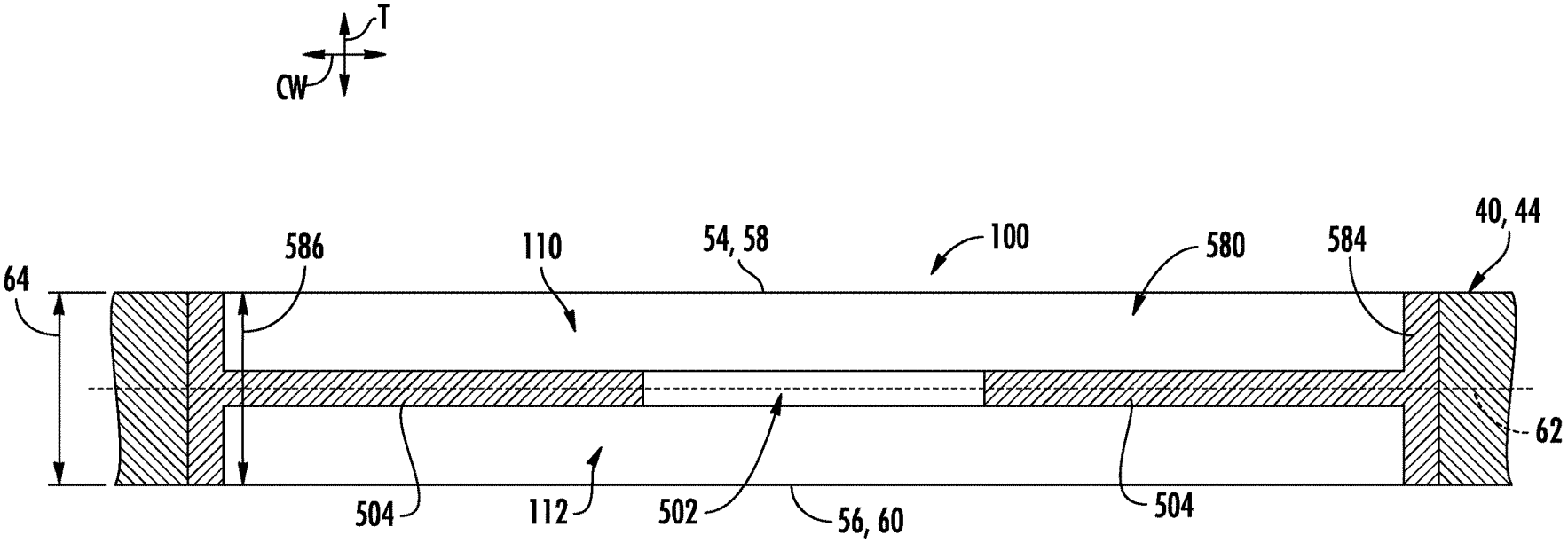
FIG. 16 illustrates a cross-sectional view of the slat and the insert shown in FIG. 15 taken about line XVI-XVI.

Moreover, as shown in FIGS. 14 and 16, in one embodiment, the radially outer end of the insert wall 504 terminates at a sidewall 584 extending around the outer perimeter of the insert 580. In such an embodiment, the sidewall 584 is configured to contact or otherwise engage the slat body 44 around the perimeter of the opening 582 when the insert 580 is installed relative to the slat 40. For instance, as shown in FIG. 16, the sidewall 584 defines a height 586 that is equal or substantially equal to the thickness 64 of the slat 40 such that the sidewall 584 engages or contacts the slat body 44 along the outer perimeter of the opening 582 from the first face 58 of the slat body 44 to the opposed second face 60 of the slat body 44. However, in other embodiments, the height 586 of the sidewall 584 may less than or greater than the thickness 64 of the slat 40. Additionally, in an alternative embodiment, the insert 580 may be configured without the sidewall 586. In such embodiments, the insert wall 504 may, for example, be configured to extend radially outwardly to the outer perimeter of the insert opening 582 such that the radially outer end of the insert wall 504 contacts or otherwise engages the slat body 44 when the insert 580 is installed relative to the slat 40.

As indicated above, the present subject matter is also directed to a cord-threading tool for inserting a cord through a route hole or slot defined in a slat. Specifically, in several embodiments, the tool may include an elongated insertion member configured to be inserted through aligned route holes/slots of a plurality of stacked slats. Additionally, a cord retention structure may be defined in or otherwise provided in operative association with the insertion member for coupling the cord to the insertion member. For instance, in one embodiment, an opening, slot, and/or other suitable retention feature may be defined at or adjacent to a tip end of the insertion member for coupling the cord to the insertion member. By coupling the cord to the insertion member, the member may be pulled through the aligned route holes/slots to thread the cord through the stacked slats. For instance, in one embodiment, the insertion member may be initially inserted through the aligned route holes/slots at one side of the stacked slats until the associated retention structure is accessible along the opposed side of the stacked slats. Once the cord is coupled to the insertion member (e.g., via the retention structure), the insertion member may then be pulled back through the aligned route holes/slots to thread the cord through the slats.

Moreover, in several embodiments, the tool may also include a nesting structure positioned at or adjacent to the cord retention feature and/or at or adjacent to the tip end of the insertion member to allow portions of the cord to be nested within or otherwise recessed relative to portions of the outer faces of the insertion member. As such, when the cord is coupled to the insertion member and the member is being pulled through the aligned route holes/slots, the portions of the cord extending adjacent to the outer faces of the insertion member may be received within the nesting structure to minimize the cross-sectional profile of the tool/cord assembly within the aligned route holes/slots. Such a minimized cross-sectional profile may, in turn, allow for the tool to be effectively and efficiently used to thread a cord through route holes/slots having through-holes with reduced dimensions, such as within route slots as disclosed herein. Moreover, the minimized cross-sectional profile may also reduce the amount of force required to pull the tool/cord assembly through the aligned route holes/slots, thereby reducing operator effort during the assembly process.

Figure 17:
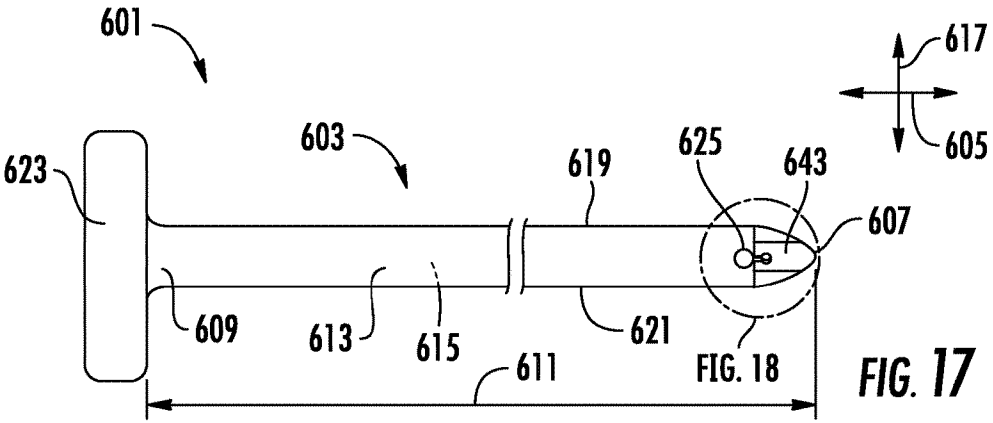
FIG. 17 illustrates a side view of one embodiment of a cord threading tool in accordance with aspects of the present subject matter.
Figure 19:
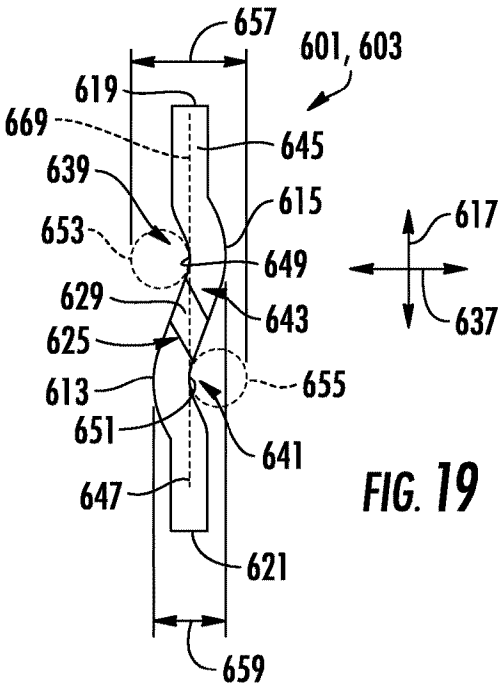
FIG. 19 illustrates a cross-sectional view of a portion of the tool shown in FIG. 18 taken about line XIX-XIX.
Figure 18:
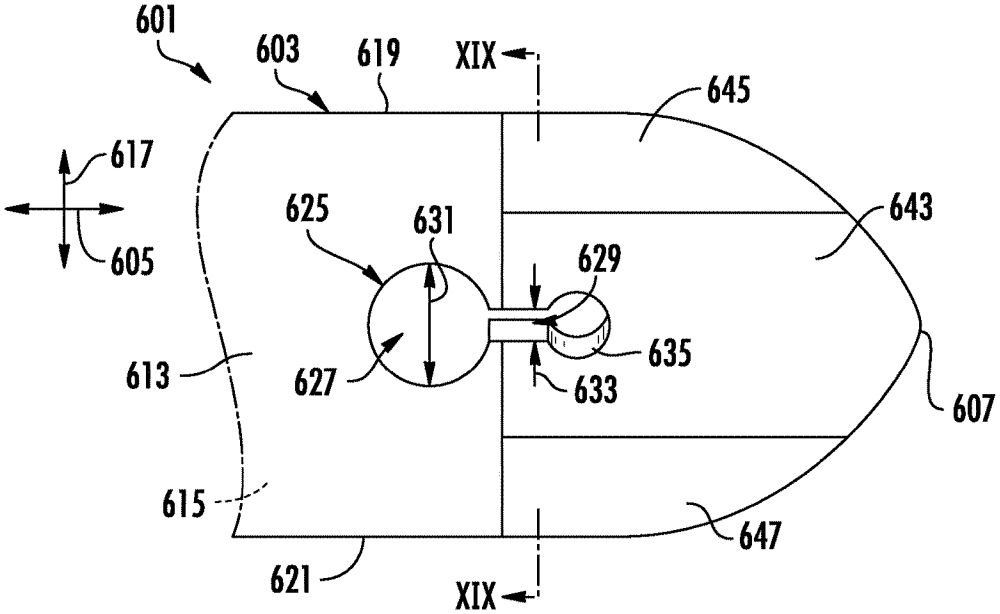
FIG. 18 illustrates an enlarged view of a portion of the tool shown in FIG. 17.

Referring now to FIGS. 17-19, one embodiment of a cord-threading tool 601 for inserting or threading a cord (e.g., a lift cord) through aligned route holes or slots of a plurality of stacked slats is illustrated in accordance with aspects of the present subject matter. For purposes of description, the tool 601 will generally be described herein in relation to its use as a tool for threading a cord (e.g., lift cord 28) through slats 40 defining an embodiment of the disclosed route slot 100 therein. However, it should be appreciated that the tool 601 may generally be used as a cord-threading tool for slats having any suitable route slot/hole configuration, including slats defining conventional route holes.

In general, the tool 601 includes an elongated insertion member configured to be inserted through aligned route slots/holes of a plurality of stacked slats. For instance, as shown in the illustrated embodiment, the tool 601 includes an insertion arm 603 extending in a lengthwise direction (e.g., as indicated by arrow 605 in FIGS. 17 and 18) between a tip end 607 and an opposed base end 609. In general, the arm 603 may define any suitable length 611 between its opposed ends 607, 609 that allows the arm 603 to be inserted through a stack of slats. For instance, the length 611 may, in one embodiment, be selected based on the maximum number of slats through which the arm 603 is anticipated to be inserted, such as by selecting the length based on the anticipated stacked height of such slats. Additionally, as shown in the illustrated embodiment, the insertion arm 603 includes opposed outer faces, such as a first outer face 613 and a second outer face 615 (FIG. 19) extending between the opposed ends 607, 609 of the arm 603 in the lengthwise direction 605. In one embodiment, the outer faces 613, 615 may also extend in a cross-wise direction of the insertion arm 603 (e.g., as indicated by arrow 617 in FIGS. 17 and 18) between opposed first and second edges 619, 621 of the arm 603.

As particularly shown in FIG. 17, the tool 601 may, optionally, include a handle 623 positioned at or adjacent to the base end 609 of the arm 603. For instance, the handle 623 may be configured to be coupled to or formed integrally with the base end 609 of the arm 603. In general, the handle 623 may correspond to a graspable member that is configured to be grasped or otherwise held by a user during use of the tool 601. Thus, it should be appreciated that handle 623 may generally have any suitable configuration, including any suitable size, shape and/or other design factors taking into account any suitable ergonomic considerations, that allows it to be held or grasped by a user, for example, when inserting the arm 603 through and/or pulling the arm 603 back out of aligned route slots/holes of a corresponding stack of slats. For instance, as opposed to the enlarged handle 623 shown in FIG. 17, the tool 601 may simply include a small protrusion or bump at the base end 609 of the arm 603 to provide a feature for grasping or gripping the tool 601.

Additionally, in several embodiments, the tool 601 may also include a cord retention structure positioned at or adjacent to the tip end 607 of the insertion arm 603 for coupling a cord to the arm 603. For instance, as particularly shown in FIG. 18, the retention structure corresponds to a retention channel 625 defined through the arm 603 at a location adjacent to its tip end 607. As shown in the illustrated embodiment, the retention channel 625 includes both an enlarged opening 627 and narrowed slot 629 extending outwardly from the opening 627 in the direction of the tip end 607 of the arm 603. In such an embodiment, the opening 627 may define a diameter 631 that is larger than the cord diameter to allow the cord to be inserted through the retention channel 625 via the opening 627. Additionally, in one embodiment, a cross-wise dimension 633 of the slot 629 may be smaller than the cord diameter to allow the cord to be retained within the retention channel 625. For example, the cord may initially be inserted through the opening 627 and then pulled into the slot 629 such that the cord is compressed within the slot 629, thereby allowing the cord to be retained within the retention channel 625. Moreover, as shown in FIG. 18, in one embodiment, an end portion 635 of the slot 629 positioned opposite the opening 627 may be enlarged relative to the remainder of the slot 629. In such an embodiment, when coupling the cord to the arm 603, the cord may be pulled through the slot 629 until the cord is received within the enlarged end portion 635 of the slot 629. The cord may then be retained within the slot 629 of the retention channel 625 (e.g., within the enlarged end portion 635 of the slot 629) as the arm 603 is being pulled through the aligned route slots/holes of the corresponding stack of slats.

As particularly shown in FIG. 19, in several embodiments, a portion of the cord retention structure (e.g., the slot 629) defines an angled orientation relative to both the cross-wise direction 617 and a thickness direction of the arm 603 (e.g., as indicated by arrow 637 in FIG. 19). In general, the angled orientation may be selected to provide an angled cord path through the arm 603. Specifically, as will be described below, the angled orientation of the slot 629 may assist in urging or forcing the cord into the adjacent nesting structure of the tool 601 as the tool and cord are being pulled through a stack of slats.

It should be appreciated that, in other embodiments, the retention structure may correspond to any other suitable structure configured to allow the cord to be coupled to the arm 603, including any suitable channel, opening, slot, notch, and/or any other retention feature.

As indicated above, the tool 601 may also include a nesting structure for nesting a portion of the cord relative to an adjacent portion of the arm 603 as the arm/cord are being pulled through the aligned route slots/holes of the corresponding stack of slats. Specifically, in several embodiments, the nesting structure may allow portions of the cord to be brought closer to a central plane of the arm 603 in order to reduce the cross-sectional profile of the tool/cord. For example, the nesting structure may allow portions of the cord to be nested relative to the opposed outer faces 613, 615 of the insertion arm 603 along all or a portion of the section of the arm 603 across which the cord extends as the arm 603 is being pulled through the aligned route slots/holes (e.g., the portion of the arm 603 defined between the retention structure 625 and the tip end 607 of the arm 603). Thus, the cross-sectional profile of the tool/cord across such section of the arm 603 may be reduced or otherwise minimized in the thickness direction 637 of the arm 603, thereby allowing the cord threading tool 601 to be used in applications including route slots/holes having reduced size or smaller through-holes.

As particularly shown in FIG. 19, in one embodiment, the nesting structure corresponds to cord cradles 639, 641 formed along the opposed faces 613, 615 of the arm 603. For example, a first cord cradle 639 is defined along the first face 613 of the arm 603, while a second cord cradle 641 is defined along the second face 615 of the arm 603. In one embodiment, the cord cradles 639, 641 may be defined by a central or nesting section 643 of the arm 603 extending in the lengthwise direction 605 between the retention structure 625 and the tip end 607 of the arm 603. For example, as shown in FIG. 19, the nesting section 643 of the arm 603 defines an undulating or wavy profile (e.g., a substantially S-shaped profile) in the cross-wise direction 617 of the arm 603 that extends between opposed, generally planar side sections of the arm 603 (e.g., a first side section 645 extending in the cross-wise direction 617 between the nesting section 643 and the first edge 619 of the arm 603 and a second side section 647 extending in the cross-wise direction 617 between the nesting section 643 and the second edge 621 of the arm 603. In such an embodiment, the profile of the nesting section 643 may be configured or selected such that the first cord cradle 639 is defined along the first face 613 of the arm 603 within a corresponding valley 649 formed by the nesting section 643 along such face 613 of the arm 603 while the second cord cradle 641 is defined along the second face 615 of the arm 603 within a corresponding valley 651 formed by the nesting section 643 along such opposed face 615 of the arm 603. As shown, the opposed valleys 649, 651 defined by the nesting section 643 are spaced apart from each other in the cross-wise direction 617 of the arm 603 so as to be positioned along opposite sides of the retention channel 625. Thus, when the cord is received within the retention channel 625, a first portion of the cord (e.g., as indicated by dashed circle 653) may extend outwardly from the channel 625 along the first face 613 of the arm 603 and be received within the first cord cradle 639, while a second portion of the cord (e.g., as indicated by dashed circle 655) may extend outwardly from the channel 625 along the second face 615 of the arm 603 and be received within the second cord cradle 641. It should be appreciated that, as an alternative to the undulating or wavy profile shown in FIG. 19, the nesting section 643 may define a generally planar profile, with each cord cradle 639, 641 corresponding to a cavity or recess defined in the otherwise planar profile of the nesting section 643.

It should be appreciated that, in one embodiment, the lowest points of the opposed valleys 649, 651 defined by the nesting section 643 may generally be aligned along a plane 669 extending in the cross-wise direction 617 through at least a portion of the arm 603. As a result, when the cord portions 653, 655 are received within the cord cradles 639, 641, a portion of each cord portion cord portion 653, 655 may be generally aligned within and/or positioned adjacent to the plane 669. In one embodiment, the plane 669 may generally correspond to a central plane of the arm 603 that extends through the center of the arm in the thickness direction 637.

It should also be appreciated that the angled orientation of the slot 629 of the retention channel 625 may assist each cord portion 653, 655 in being received within its corresponding cord cradle 639, 641. For example, as shown in FIG. 19, the slot 629 is angled so as to provide an angled cord path extending directly between the opposed cord cradles 639, 641. As such, when the cord is inserted into the slot 629, each opposed cord portion 653, 655 may extend outwardly from the slot 629 and directly into its associated cord cradle 639, 641. It should be appreciated that the specific angle at which the slot 629 is oriented relative to the cross-wise direction 617 and/or the thickness direction 637 may generally vary depending on the configuration of the tool and/or the size of the cord. As indicated above, the angle may generally be selected to facilitate receipt of the cord within the associated nesting structure when the cord is coupled to the arm via the retention structure.

As shown in FIG. 19, with the portions 653, 655 of the cord received within the cord cradles 639, 641, the tool/cord assembly may generally define a combined or effective thickness 657 along the thickness direction 637 of the tool 601. In one embodiment, the thickness 657 may be less than or equal to the corresponding dimension of the route slots/holes through which the tool/cord assembly is configured to be pulled (e.g., the through-hole width 114 of the route slot 100 shown in FIG. 7). Alternatively, the effective thickness 657 may be greater than the corresponding dimension of the route slots/holes (e.g., the through-hole width 114 shown in FIG. 7). For instance, as shown in FIG. 19, when the diameter of the cord is larger than the radius of curvature of the cord cradles 639, 641 such that each cord portion 653, 655 extends outwardly in the thickness direction 637 beyond the adjacent outer face 613, 615 of the arm 603, the effective thickness 657 of the tool/assembly may be greater than an overall thickness 659 of the arm 603 itself. In such an embodiment, if the effective thickness 657 of the tool/assembly is greater than the corresponding dimension of the route slots/holes (e.g., the through-hole width 114 shown in FIG. 7), each cord portion 653, 655 may be compressed between the slats and its corresponding cradle 639, 641 as the arm 603 is being pulled through the aligned slots/holes, thereby allowing the effective thickness 657 of the tool/assembly to be reduced within the aligned slots/holes.

Figure 20B:
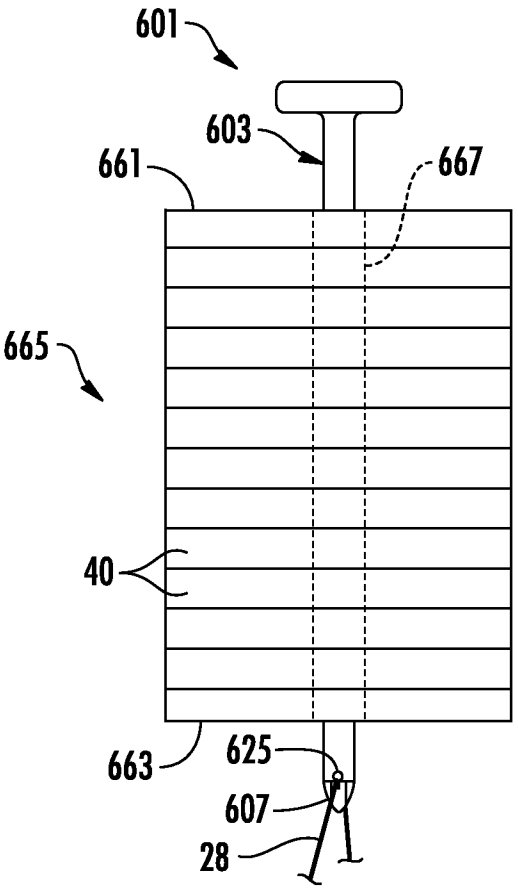
FIGS. 20A, 20B, 20C, and 20D illustrate views of one embodiment of a cord-threading process for threading a cord through aligned route slots/holes of stacked slats using the tool shown in FIG. 17.
Figure 20A:
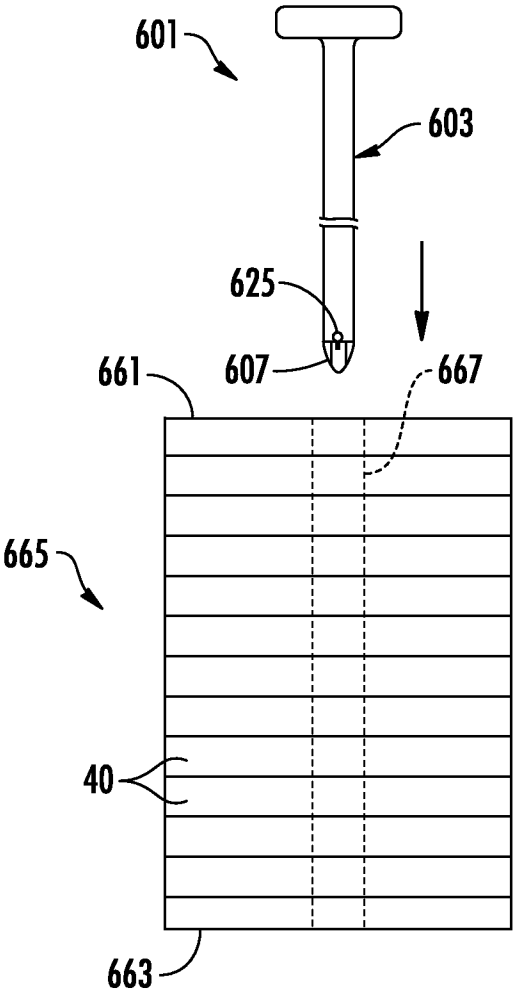
Figure 20D:
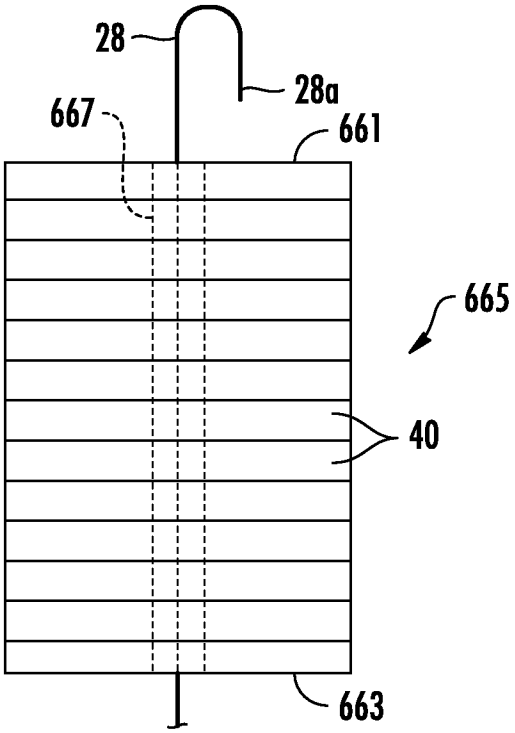
Figure 20C:
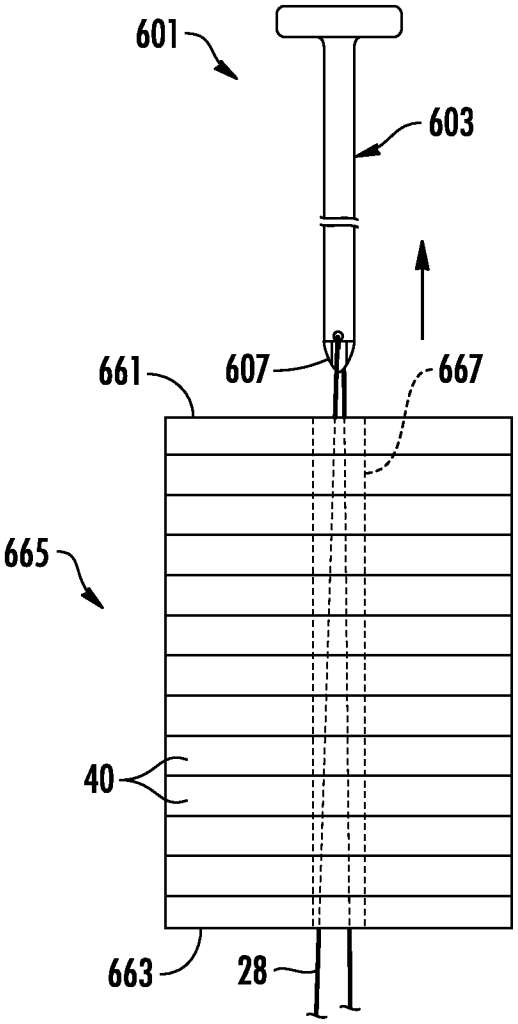

One embodiment of a cord-threading process using the tool 601 described above with reference to FIGS. 16-19 is illustrated in FIGS. 20A-20D As shown in FIGS. 20A and 20B, the tip end 607 of the tool arm 603 is initially positioned relative to a first side 661 of a stack 665 of slats 40 and subsequently inserted through the aligned route slots (indicated by dashed lines 667) of the stacked slats 40 such that the tip end 607 and associated retention structure 625 is accessible along an opposed second side 663 of the stacked slats 40. As shown in FIG. 20B, the cord 28 is then be coupled to the tool arm 603 via the retention structure 625. Thereafter, as shown in FIG. 20C, the arm 603 is pulled back through the stacked slats 40 to thread the cord 28 through the aligned route slots 667. In doing so, the configuration of the nesting structure (e.g., the profile of the nesting section 643 of the arm 603) may force the portions of the cord 28 overlapping the arm 603 (e.g., the cord portions 653, 655 shown in FIG. 19) into the cord cradles 639, 641 (FIG. 19) as the arm 603 is pulled through the aligned route slots 667. As shown in FIG. 20D, once the cord 28 has been threaded through the aligned route slots 667, the cord 28 may be detached from the tool 601 and one end 28*a* of the cord 28 pulled through the aligned route slots 667 such that a single run of the cord 28 extends through the slats 40.

While the foregoing Detailed Description and drawings represent various embodiments, it will be understood that various additions, modifications, and substitutions may be made therein without departing from the spirit and scope of the present subject matter. Each example is provided by way of explanation without intent to limit the broad concepts of the present subject matter. In particular, it will be clear to those skilled in the art that principles of the present disclosure may be embodied in other forms, structures, arrangements, proportions, and with other elements, materials, and components, without departing from the spirit or essential characteristics thereof. For instance, features illustrated or described as part of one embodiment can be used with another embodiment to yield a still further embodiment. Thus, it is intended that the present subject matter covers such modifications and variations as come within the scope of the appended claims and their equivalents. One skilled in the art will appreciate that the disclosure may be used with many modifications of structure, arrangement, proportions, materials, and components and otherwise, used in the practice of the disclosure, which are particularly adapted to specific environments and operative requirements without departing from the principles of the present subject matter. For example, elements shown as integrally formed may be constructed of multiple parts or elements shown as multiple parts may be integrally formed, the operation of elements may be reversed or otherwise varied, the size or dimensions of the elements may be varied. The presently disclosed embodiments are therefore to be considered in all respects as illustrative and not restrictive, the scope of the present subject matter being indicated by the appended claims, and not limited to the foregoing description.

In the foregoing Detailed Description, it will be appreciated that the phrases "at least one", "one or more", and "and/or", as used herein, are open-ended expressions that are both conjunctive and disjunctive in operation. The term "a" or "an" element, as used herein, refers to one or more of that element. As such, the terms "a" (or "an"), "one or more" and "at least one" can be used interchangeably herein. All directional references (e.g., proximal, distal, upper, lower, upward, downward, left, right, lateral, longitudinal, front, rear, top, bottom, above, below, vertical, horizontal, crosswise, radial, axial, clockwise, counterclockwise, and/or the like) are only used for identification purposes to aid the reader's understanding of the present subject matter, and/or serve to distinguish regions of the associated elements from one another, and do not limit the associated element, particularly as to the position, orientation, or use of the present subject matter. Connection references (e.g., attached, coupled, connected, joined, secured, mounted and/or the like) are to be construed broadly and may include intermediate members between a collection of elements and relative movement between elements unless otherwise indicated. As such, connection references do not necessarily infer that two elements are directly connected and in fixed relation to each other. Identification references (e.g., primary, secondary, first, second, third, fourth, etc.) are not intended to connote importance or priority, but are used to distinguish one feature from another.

All apparatuses and methods disclosed herein are examples of apparatuses and/or methods implemented in accordance with one or more principles of the present subject matter. These examples are not the only way to implement these principles but are merely examples. Thus, references to elements or structures or features in the drawings must be appreciated as references to examples of embodiments of the present subject matter, and should not be understood as limiting the disclosure to the specific elements, structures, or features illustrated. Other examples of manners of implementing the disclosed principles will occur to a person of ordinary skill in the art upon reading this disclosure.

This written description uses examples to disclose the present subject matter, including the best mode, and also to enable any person skilled in the art to practice the present subject matter, including making and using any devices or systems and performing any incorporated methods. The patentable scope of the present subject matter is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

The following claims are hereby incorporated into this Detailed Description by this reference, with each claim standing on its own as a separate embodiment of the present disclosure. In the claims, the term "comprises/comprising" does not exclude the presence of other elements or steps. Furthermore, although individually listed, a plurality of means, elements or method steps may be implemented by, e.g., a single unit or processor. Additionally, although individual features may be included in different claims, these may possibly advantageously be combined, and the inclusion in different claims does not imply that a combination of features is not feasible and/or advantageous. In addition, singular references do not exclude a plurality. The terms "a", "an", "first", "second", etc., do not preclude a plurality. Reference signs in the claims are provided merely as a clarifying example and shall not be construed as limiting the scope of the claims in any way.

What is claimed is:

1. A covering for an architectural structure, said covering comprising:

a headrail;

a bottom rail spaced apart, from said headrail in a vertical direction;

a plurality of slats supported between said headrail and said bottom rail, each slat of said plurality of slats being tiltable between an open position, at which said slat has a horizontal orientation, and a closed position, at which said slat is oriented at a maximum tilt angle relative to the vertical direction; and a lift cord passing through each of said plurality of slats and extending between said headrail and said bottom rail;

each slat of said plurality of slats comprising:

a slat body including opposed first and second faces extending in a longitudinal direction between first and second lateral ends of said slat body and in a crosswise direction between first and second edges of said slat body; and a route slot at least partially defined by a route wall that is recessed relative to said first and second faces of said slat body, said route wall at least partially dividing said route slot into a first recess extending between said first face of said slat body and said route wall and a second recess extending between said second face of said slat body and said route wall, with said first recess being at least partially separated from said second recess in a thickness direction of said slat by said route wall, said route wall extending radially from an outer end of said route wall to an inner end of said route wall, said inner end of said route wall defining a through-hole of said route slot;

wherein:

said through-hole connects said first recess to said second recess at a location between said first and second faces of said slat body to allow said lift cord to be passed through said route slot;

a thickness of said route wall defined in said thickness direction tapers at a taper angle as said route wall extends from said outer end of said route wall to said inner end of said route wall; and said taper angle of said route wall is configured such that, when said slat body is oriented at the maximum tilt angle of said slat, said lift cord at least partially contacts a first sloped surface of said route wall defining a portion of said first recess and at least partially contacts a second sloped surface of said route wall defining a portion of said second recess, said first and second sloped surfaces are configured to allow said lift cord to be substantially vertical and substantially straight as said lift cord contacts a majority of said first and second sloped surfaces at the maximum tilt angle of said slat.

2. The covering of claim 1, wherein said route wall is formed by a portion of said slat body.

3. The covering of claim 1, wherein said route wall is formed by a separate insert installed relative to said slat body.

4. The covering of claim 1, wherein said outer end of said route wall defines an outer perimeter of said route slot.

5. The covering of claim 1, wherein said thickness of said route wall tapers such that said route wall defines a tapered profile between said outer and inner ends of said route wall.

6. The covering claim 1, wherein said taper angle is equal to the maximum tilt angle for said slat.

7. The covering of claim 1, wherein:

said route wall is tapered such that said thickness of said route wall decreases as said route wall extends from said outer end of said route wall to said inner end of said route wall;

said slat body defines a central slat plane that is centered between and extends parallel to said first and second faces of said slat body; and said inner end of said route wall is recessed relative to said first and second faces of said slat body such that said through-hole is aligned or substantially aligned with the central slat plane of said slat body.

8. The covering of claim 1, wherein said lift cord is configured to pass freely through said through-hole as said bottom rail is raised and lowered relative said headrail.

9. The covering of claim 1, wherein said lift cord is maintained in a vertically straight orientation as said lift cord passes through each of said plurality of slats and extends between said headrail and said bottom rail.

10. The covering of claim 5, wherein said tapered profile is configured such that said thickness of said route wall decreases as said route wall extends from said outer end of said route wall to said inner end of said route wall.

11. A covering for an architectural structure, said covering comprising:

a headrail;

a bottom rail spaced apart from said headrail in a vertical direction;

a plurality of slats supported between said headrail and said bottom rail, each slat of said plurality of slats being tiltable between an open position, at which said slat has a horizontal orientation, and a closed position, at which said slat is oriented at a maximum tilt angle relative to the vertical direction; and a lift cord passing through each of said plurality of slats and extending between said headrail and said bottom rail;

each slat of said plurality of slats comprising:

a slat body including opposed first and second faces extending in a longitudinal direction of said slat body between first and second lateral ends of said slat body and in a crosswise direction of said slat body between first and second edges of said slat body, said first and second faces being spaced apart from each other in a thickness direction of said slat body; and a route wall at least partially recessed relative to at least one of said first face or said second face in said thickness direction of said slat body such that said route wall defines at least one recess along said at least one of said first face or said second face of said slat body, said route wall further defining a through-hole between said first and second faces for passing said lift cord through said slat body;

wherein:

said at least one recess is enlarged relative to said through-hole in at least one of said longitudinal direction or said cross-wise direction;

said at least one recess comprises a first recess extending between said first face of said slat body and said route wall and a second recess extending between said second face of said slat body and said route wall;

said lift cord passes freely through said through-hole such that said lift cord moves relative to said slat body as said bottom rail is raised and lowered relative said headrail;

a thickness of said route wall defined in said thickness direction tapers at a taper angle as said route wall extends from an outer end of said route wall to an inner end of said route wall such that, when said slat body is oriented at the maximum tilt angle of said slat, said lift cord extends along and contacts a majority of both a first sloped surface of said route wall defining portion of said first recess and a second sloped surface of said route wall defining a portion of said second recess; and said first and second sloped surfaces are configured to allow said lift cord to be substantially vertical and substantially straight when said slat body is oriented at the maximum tilt angle.

12. The covering of claim 11, wherein:

said at least one recess defines an outer perimeter;

said through-hole defines a perimeter along an inner end of said route wall; and a dimension of said outer perimeter of said at least one recess in said at least one of said longitudinal direction or said cross-wise direction is greater than a corresponding dimension of said perimeter of said through-hole in said at least one said longitudinal direction or said cross-wise direction.

13. The covering of claim 11, wherein said first and second recesses are enlarged relative to said through-hole such that at least a portion of each of said first and second recesses defines a recessed cord path extending outwardly from a perimeter of said through hole in said cross-vise direction for receiving a portion of said lift cord.

14. The covering of claim 11, wherein;

said plurality of slats are supported in the vertical direction between said headrail and said bottom rail via one or more cord ladders; and said plurality of slats are configured to be tilted together between the opened and closed positions via manipulation of said one or more cord ladders.

15. The covering of claim 11, wherein:

said through-hole defines a through-hole width in said longitudinal direction of said slat body; and said through-hole width is configured such that said through-hole is substantially filled by said lift cord in both said longitudinal direction and said crosswise direction of said slat body when said slat body is tilted to the maximum tilt angle.

16. The covering of claim 12, wherein said through-hole defines a through-hole length in said crosswise direction of said slat body; and said at least one recess defines a slot length in said crosswise direction of said slat body that is greater than said through-hole length of said through-hole.

17. The covering of claim 13, wherein the portion of said lift cord is configured to be received within said recessed cord path when said slat body is oriented relative to said lift cord at the maximum tilt angle.

* * * * *